US011072183B2

(12) United States Patent
Koizumi et al.

(10) Patent No.: US 11,072,183 B2
(45) Date of Patent: Jul. 27, 2021

(54) CARTRIDGE AND LIQUID EJECTION SYSTEM

(71) Applicant: Seiko Epson Corporation, Tokyo (JP)

(72) Inventors: Yoshihiro Koizumi, Shiojiri (JP); Shun Oya, Nagano-ken (JP); Kotoya Aruga, Nagano-ken (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/779,881

(22) Filed: Feb. 3, 2020

(65) Prior Publication Data

US 2020/0254769 A1 Aug. 13, 2020

(30) Foreign Application Priority Data

Feb. 12, 2019 (JP) ..... JP2019-022392

(51) Int. Cl.
*B41J 2/175* (2006.01)
*B41J 2/01* (2006.01)

(52) U.S. Cl.
CPC ..... *B41J 2/17543* (2013.01); *B41J 2/1752* (2013.01); *B41J 2/17503* (2013.01); *B41J 2/17513* (2013.01); *B41J 2/17523* (2013.01); *B41J 2/17556* (2013.01); *B41J 2/01* (2013.01); *B41J 2/175* (2013.01); *B41J 2/17526* (2013.01); *B41J 2/17546* (2013.01); *B41J 2/17553* (2013.01); *B41J 2/17559* (2013.01)

(58) Field of Classification Search
CPC .. B41J 2/17543; B41J 2/17503; B41J 2/1752; B41J 2/17556; B41J 2/17513; B41J 2/17523; B41J 2/01; B41J 2/17526; B41J 2/17546; B41J 2/17559; B41J 2/175; B41J 2/17553
See application file for complete search history.

(56) References Cited

U.S. PATENT DOCUMENTS 9,889,672 B2 2/2018 Kobayashi et al.
2016/0288511 A1* 10/2016 Koizumi ..... B41J 2/17513
2016/0288514 A1* 10/2016 Koizumi ..... B41J 2/17513
2018/0215161 A1* 8/2018 Koizumi ..... B41J 2/175

FOREIGN PATENT DOCUMENTS

JP 2018-122518 A 8/2018

* cited by examiner

*Primary Examiner* — Yaovi M Ameh
(74) *Attorney, Agent, or Firm* — Oliff PLC

(57) ABSTRACT

A cartridge mountable on a liquid ejection device is provided. The liquid ejection device includes a mounting section, an air supplying portion including an air supplying passage, and a detection section configured to detect an error when a predetermined air pressure is not reached even if air is supplied from the air supplying portion. The cartridge includes a case including a communication portion and a first leakage limiting portion that limits leakage of air supplied from the air supplying portion into an atmosphere. The communication portion includes a second leakage limiting portion that limits leakage of the air supplied from the air supplying portion into the case through the communication portion.

8 Claims, 14 Drawing Sheets

CARTRIDGE AND LIQUID EJECTION SYSTEM

CROSS-REFERENCE TO RELATED APPLICATIONS

This application is based upon and claims the benefit of priority from prior Japanese Patent Application No. 2019-022392, filed on Feb. 12, 2019, the entire contents of which are incorporated herein by reference.

BACKGROUND

1. Field

The present disclosure relates to a cartridge and a liquid ejection system that includes a cartridge and a liquid ejection device to which the cartridge is mounted.

2. Description of Related Art

A typical pressurization type liquid ejection system includes a liquid ejection device including a liquid ejection head and a cartridge mounted on the liquid ejection device. The cartridge stores liquid to be supplied to the liquid ejection head.

The liquid injection device includes a cartridge mounting section and a pressurizing mechanism configured to supply pressurized air to the cartridge mounted on the cartridge mounting section. The cartridge includes a case having a pressurizing chamber to which pressurized air is supplied, and a liquid container disposed in the pressurizing chamber. The cartridge is mounted in the liquid injection device by being moved in the mounting direction and inserted into the cartridge mounting section.

For example, JP-A-2018-122518 discloses a cartridge including an airbag that stirs liquid in a liquid container. The airbag is inflated when pressurized air is supplied from the pressurizing mechanism described above, and deflated when the supply of pressurized air from the pressurizing mechanism is stopped. The airbag stirs the liquid in the liquid container by such inflation and deflation. The cartridge mounting section includes an air supplying portion for supplying the pressurized air for stirring to the cartridge, and the cartridge includes a stirring fluid circulating portion connected to the air supplying portion.

The liquid ejection device including the air supplying portion has a function of determining that there is an error when the air pressure of the air supplying portion does not reach a predetermined air pressure during the supply of pressurized air. Therefore, in order to mount a cartridge not including an airbag to a liquid ejection device including an air supplying portion, a technique for causing the air pressure of the air supplying portion to reach a predetermined air pressure during the supply of pressurized air is necessary.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In accordance with one aspect of the present disclosure, a cartridge mountable on a liquid ejection device is provided. The liquid ejection device includes a mounting section, an air supplying portion, and a detection section. The cartridge and a different cartridge including an airbag are replaceably mounted to the mounting section. The cartridge and the different cartridge are capable of supplying liquid to a liquid ejection head that ejects the liquid. The air supplying portion includes an air supplying passage. The air supplying portion is configured to supply air to the airbag of the different cartridge mounted on the mounting section. The detection section is configured to detect an error when a predetermined air pressure is not reached even if air is supplied from the air supplying portion. The cartridge includes a case and a first leakage limiting portion. The case stores the liquid or allows the externally supplied liquid to pass through. The case includes a communication portion that communicates with the air supplying passage in a mounted state in which the cartridge is mounted on the liquid ejection device. The first leakage limiting portion limits leakage of air supplied from the air supplying portion into an atmosphere by cooperating with the air supplying portion in the mounted state. The communication portion includes a second leakage limiting portion that limits leakage of the air supplied from the air supplying portion into the case through the communication portion.

In accordance with one aspect of the present disclosure, a cartridge mountable on a liquid ejection device is provided. The liquid ejection device includes a mounting section, an air supplying portion, and a detection section. The cartridge and a different cartridge including an airbag are replaceably mounted to the mounting section. The cartridge and the different cartridge are capable of supplying liquid to a liquid ejection head that ejects the liquid. The air supplying portion includes an air supplying passage. The air supplying portion is configured to supply air to the airbag of the different cartridge mounted on the mounting section. The detection section is configured to detect an error when a predetermined air pressure is not reached even if air is supplied from the air supplying portion. The cartridge includes a case that stores the liquid or allows the externally supplied liquid to pass through. The case includes a leakage limiting portion that limits leakage of air from the air supplying passage by closing the air supplying passage in a mounted state in which the cartridge is mounted on the liquid ejection device.

In accordance with one aspect of the present disclosure, a liquid ejection system is provided that includes the above-described cartridge, a liquid ejection head that ejects liquid, a mounting section to which the cartridge and a different cartridge including an airbag are replaceably mounted, a liquid supplying portion, an air supplying portion, and a detection section. The liquid supplying portion is configured to supply the liquid from the cartridge or the different cartridge mounted on the mounting section to the liquid ejection head. The air supplying portion is configured to supply air to the airbag. The detection section is configured to detect an error when a predetermined air pressure is not reached even if air is supplied from the air supplying portion.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

A cartridge 130 and a liquid ejection system according to a first embodiment will be described with reference to FIGS. 1 to 7. A cartridge 130 (see FIGS. 6 and 7) according to the first embodiment not including an airbag and a different cartridge 13 (see FIGS. 3 and 4) including an airbag are replaceably mounted to a liquid ejection device 12. An example of the liquid ejection device is an inkjet type printer that prints characters or images on a medium by ejecting ink, which is an example of a liquid, onto a medium such as paper. The liquid ejection system includes one or more cartridges and a liquid ejection device. In particular, the liquid ejection system includes a cartridge not including an airbag and a liquid ejection device.

Figure 1:
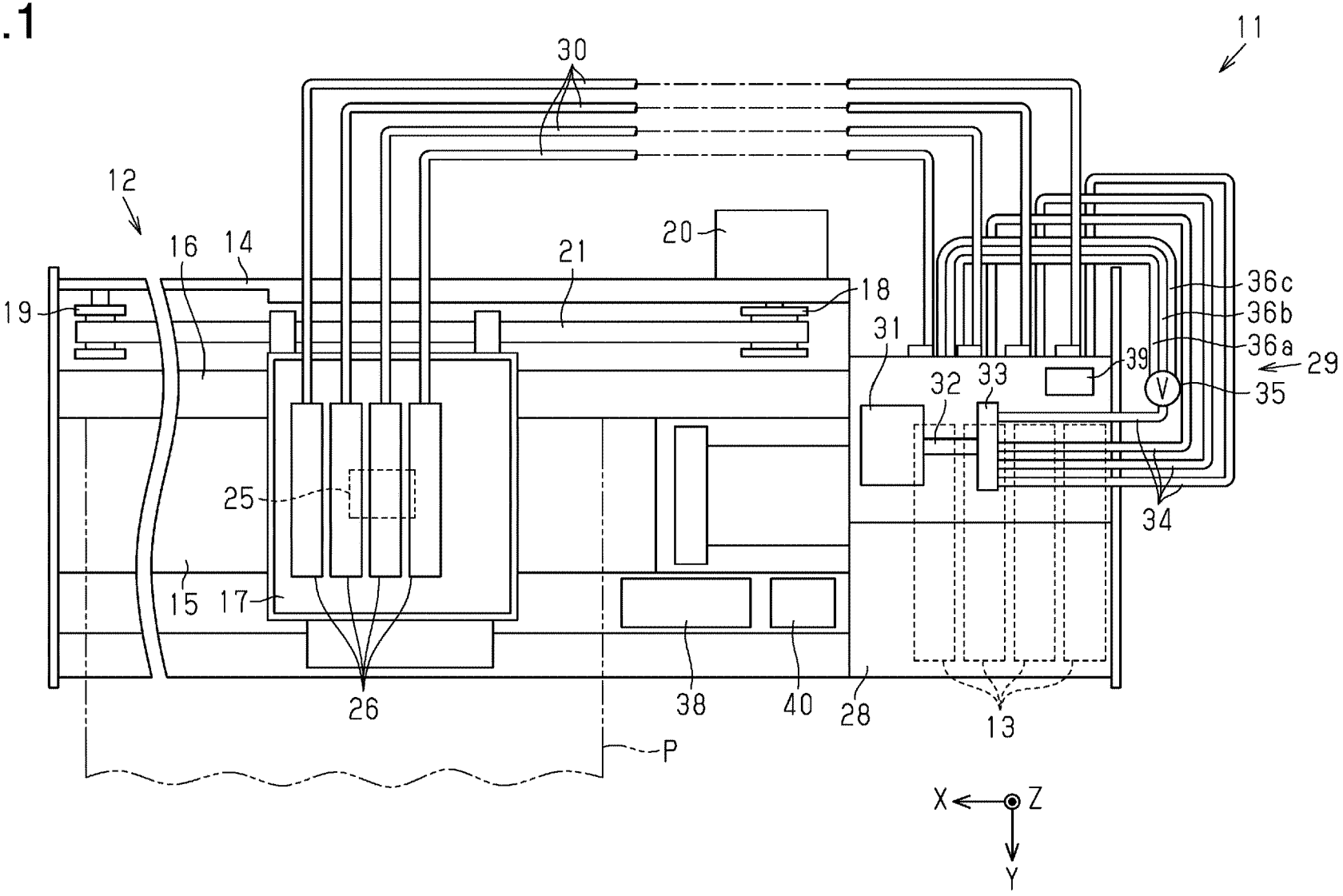
FIG. 1 is a diagram showing a schematic configuration of a liquid ejection system including cartridges and a liquid ejection device according to a first embodiment.

FIG. 1 shows a schematic configuration of a liquid ejection system 11. The X axis, the Y axis, and the Z axis shown in FIG. 1 are three spatial axes that are orthogonal to each other. The directions indicated by arrows in the X axis, the Y axis, and the Z axis are the +X direction, the +Y direction, and the +Z direction, respectively. The directions opposite to the +X direction, +Y direction, and +Z direction are the −X direction, the −Y direction, and the −Z direction, respectively. The XYZ axes depicted in FIGS. 2 to 21 correspond to the XYZ axes in FIG. 1. In a usage state in which the liquid ejection system 11 is installed on a horizontal plane including the X axis and the Y axis, the +Z direction is the vertically upward direction and the −Z direction is the vertically downward direction. In the following description, being located in a region advanced in the +X direction from a certain object A is referred to as "located in a region on the +X direction side with respect to the object A", and being located in a region advanced in the −X direction from a certain object A is referred to as "located in a region on the −X direction side with respect to the object A". The same applies to the direction along the Y axis and the direction along the X axis.

The liquid ejection system 11 includes the liquid ejection device 12 and one or more cartridges mounted on the liquid ejection device 12. In the liquid ejection device 12 of FIG. 1, four different cartridges 13 containing inks having different properties, for example, inks of different colors such as cyan, magenta, yellow, and black are contained.

The liquid ejection device 12 includes a box-shaped main body case 14, a supporting base 15, a guide shaft 16, a carriage 17, a driving pulley 18, a driven pulley 19, and a carriage motor 20.

The supporting base 15 is extended inside the main body case 14 along the X axis, and supports a sheet of recording paper P from below. The carriage 17 moves along a main scanning axis. The sheet of recording paper P is fed on the supporting base 15 along a sub-scanning axis orthogonal to the main scanning axis by a paper feeding mechanism (not shown). In the liquid ejection device 12, the main scanning axis extends along the X axis, and the sub-scanning axis extends along the Y axis.

The guide shaft 16 is located in a region on the +Z direction side with respect to the supporting base 15. The guide shaft 16 is a rod-shaped member extending along the main scanning axis, that is, the X axis. The guide shaft 16 supports the carriage 17 so as to be movable along the guide shaft 16. The driving pulley 18 is located in a region on the −Y direction side with respect to an end in the −X direction of the guide shaft 16. The driving pulley 18 is rotatable about a rotation axis extending along the Y axis. The driven pulley 19 is located in a region on the −Y direction side with respect to the end in the +X direction of the guide shaft 16. The driven pulley 19 is rotatable about a rotation axis extending along the Y axis. An output shaft of the carriage motor 20 is connected to the driving pulley 18. An endless timing belt 21 that supports the carriage 17 is wound around the driving pulley 18 and the driven pulley 19. The carriage 17 reciprocates along the guide shaft 16 when the carriage motor 20 is driven.

A liquid ejection head 25 and valve units 26 are mounted on the carriage 17. The liquid ejection head 25 is located in a region on the −Z direction side with respect to the carriage 17. The liquid ejection head 25 ejects ink onto the sheet of recording paper P supported by the supporting base 15. The valve unit 26 is disposed in a region on the +Z direction side with respect to the liquid ejection head 25. The valve unit 26 stores ink ejected from the liquid ejection head 25. Four valve units 26 corresponding to the four cartridges 13 are mounted on the carriage 17 of the present embodiment.

The liquid ejection device 12 includes a cartridge mounting section 28, a pressurizing mechanism 29, and ink passages 30. Cartridges 13 are mounted on the cartridge mounting section 28. The pressurizing mechanism 29 separately supplies pressurized air to the cartridges 13 mounted on the cartridge mounting section 28. Each ink passage 30 connects the cartridge 13 and the valve unit 26 corresponding to each other separately. When the pressurizing mechanism 29 supplies pressurized air to one or more cartridges 13 mounted on the cartridge mounting section 28, the ink in the corresponding cartridge 13 is supplied to the valve unit 26 through the ink passage 30.

The pressurizing mechanism 29 is disposed in the main body case 14. The pressurizing mechanism 29 includes a pressurizing pump 31, a common passage 32, a distributor 33, and a distribution passage 34. The pressurizing pump 31 generates pressurized air by compressing air in the atmosphere. The common passage 32 has an upstream end connected to the pressurizing pump 31. The distributor 33 is connected to a downstream end of the common passage 32 and upstream ends of the distribution passages 34. The distributor 33 distributes the pressurized air flowing in through the common passage 32 to the distribution passages 34. Each distribution passage 34 is provided in correspondence with the corresponding cartridge 13 and has a downstream end connected to the corresponding cartridge 13. One of the distribution passages 34 is provided with a valve 35 in the middle, and the distribution passage 34 includes a first branch passage 36*a*, a second branch passage 36*b*, and a third branch passage 36*c* between the valve 35 and the cartridge 13.

The liquid ejection device 12 includes a control section 38 that integrally controls the liquid ejection device 12. The control section 38 includes a processing circuit including, for example, a computer and a memory. For example, the control section 38 controls driving of the pressurizing mechanism 29 and ejection of ink by the liquid ejection head 25 according to a program stored in the memory. The control section 38 calculates the remaining amount of ink based on the amount of ink ejected by the liquid ejection head 25. The control section 38 writes the calculated remaining amount of ink in the memory mounted on the cartridge 13. The control section 38 controls the supply of pressurized air to one or more cartridges 13 by controlling, for example, driving of the pressurizing pump 31, opening/closing of the valve 35, and operation of the pressurizing mechanism 29. In the cartridge 13 to which the pressurized air is supplied, the ink container 100 shown in FIG. 4 containing the ink is pressed. As a result, the ink contained in each ink container 100 is supplied to the valve unit 26 through the corresponding ink passage 30.

To the cartridge 13, to which the first branch passage 36*a*, the second branch passage 36*b*, and the third branch passage 36*c* are connected, pressurized air for supplying ink to the liquid ejection head 25 is supplied through the first branch passage 36*a*. The pressurized air for stirring the ink contained in the ink container 100 is supplied to the cartridge 13 through the second branch passage 36*b* and the third branch passage 36*c*.

The liquid ejection device 12 includes a pressure detection section 39 and a notification section 40. The pressure detection section 39 detects the pressure in the distribution passages 34 and outputs a signal indicating the detected pressure to the control section 38. The notification section 40 notifies the user of an error indicating that an abnormality occurred in the liquid ejection system 11 by, for example, issuing a warning sound or a warning voice. The notification section 40 may be a monitor that displays an error message, or may be a light that indicates an error by lighting or blinking. The notification section 40 is controlled by the control section 38.

The control section 38 acquires the pressures of the distribution passages 34 detected by the pressure detection section 39, and determines whether the pressurized air is normally supplied by the pressurizing mechanism 29 based on the acquired pressures. The control section 38 determines that an error occurred when the pressurized air is not normally supplied by the pressurizing mechanism 29, and drives the notification section 40 to notify the user of the error. The control section 38 is a detection section that detects an error when a predetermined air pressure is not reached even if pressurized air is supplied from the pressurizing mechanism 29, and interrupts the process being executed and drives the notification section 40 when the error is detected.

Specifically, the control section 38 acquires a first pressure which is the pressure of the first branch passage 36*a*, a second pressure which is the pressure of the second branch passage 36*b*, and a third pressure which is the pressure of the third branch passage 36*c*. The control section 38 determines whether the acquired second pressure satisfies an appropriate condition, and drives the notification section 40 when the second pressure does not satisfy the appropriate condition. The appropriate condition for the second pressure is that the second pressure reaches a predetermined air pressure during the supply of pressurized air to the second branch passage 36*b*. When the second pressure does not reach the predetermined air pressure, the control section 38 determines that the appropriate condition is not satisfied, and detects an error. Furthermore, the control section 38 determines whether the acquired third pressure satisfies the appropriate condition, and drives the notification section 40 when the third pressure does not satisfy the appropriate condition. The appropriate condition for the third pressure is, for example, that the third pressure reaches a predetermined appropriate value during the supply of pressurized air to the third branch passage 36*c*. When the third pressure does not reach the predetermined air pressure, the control section 38 determines that the appropriate condition is not satisfied, and detects an error.

Figure 2:
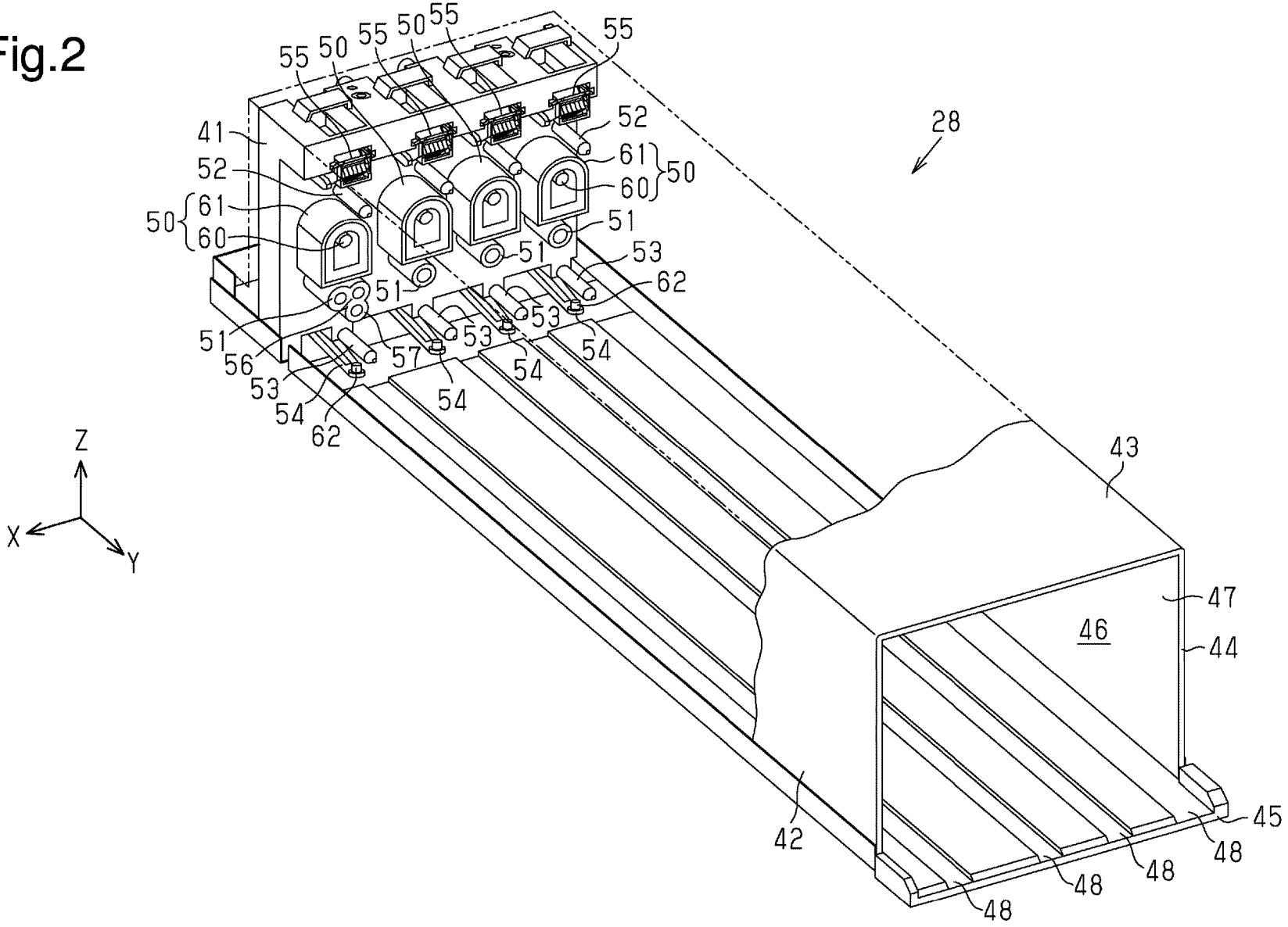
FIG. 2 is a perspective view showing a cartridge mounting section provided in the liquid ejection device of FIG. 1 with a part of the configuration omitted.

FIG. 2 is a perspective view showing an example of the cartridge mounting section 28, shows the cartridge mounting section with a part of the configuration omitted so that the internal configuration of the cartridge mounting section 28 can be visually recognized. The moving direction of the cartridge 13 when mounting the cartridge 13 on the cartridge mounting section 28 is referred to as the mounting direction. The mounting direction is the −Y direction.

As shown in FIG. 2, the cartridge mounting section 28 is a substantially rectangular parallelepiped extending along the Y axis, and includes a device-side end wall portion (device-side front wall portion) 41 and a device-side side wall portions 42, 43, 44, 45. The cartridge mounting section 28 has a cartridge containing chamber 46 defined by these wall portions 41, 42, 43, 44, 45. In the usage state of the liquid ejection device 12, the device-side end wall portion 41 extends along the X axis and the Z axis. The device-side side wall portions 42 to 45 are extended in the +Y direction from the peripheral edge of the device-side end wall portion 41. The cartridge mounting section 28 includes a mounting port 47 defined by the device-side side wall portions 42 to 45 in a region on the +Y direction side with respect to the device-side end wall portion 41. The mounting port 47 is an inlet for cartridges 13 contained in the cartridge containing chamber 46. In the cartridge mounting section 28, a portion that contains one cartridge 13 is referred to as a slot 48. The cartridge mounting section 28 of the present embodiment includes four slots 48 arranged along the X axis.

The cartridge mounting section 28 includes an ink introducing mechanism 50, an ink pressurizing portion 51, a first device-side positioning portion 52, a second device-side positioning portion 53, a device-side restricting portion 54, and a device-side terminal portion 55. These are supported by the device-side end wall portion 41, and are provided for each slot 48 so as to correspond to each of the cartridges 13. Furthermore, the cartridge mounting section 28 includes a first air supplying portion 56 and a second air supplying portion 57 in one of the slots 48. The first air supplying portion 56 and the second air supplying portion 57 are supported by the device-side end wall portion 41. When the first air supplying portion and the second air supplying portion are not distinguished, it is simply referred to as an air supplying portion.

When the cartridge 13 is connected to each ink introducing mechanism 50, the ink in the cartridge 13 is ready to be introduced into the liquid ejection device 12. The ink introducing mechanisms 50 are located at the center along the Z-axis of the device-side end wall portion 41. Each ink introducing mechanism 50 includes an ink introducing portion 60 and a cover portion 61. The ink introducing portions 60 are tubular protrusions extending in the +Y direction from the device-side end wall portion 41. When the cartridge 13 is attached to the cartridge mounting section 28, such cartridge 13 is connected to the corresponding ink introducing portion 60.

The cover portion 61 is a peripheral wall that surrounds the periphery of the ink introducing portion 60. The cover portion 61 limits scattering of ink when the cartridge 13 is mounted and removed. The cover portion 61 is movable along the Y axis and is biased in the +Y direction by a biasing member (not shown) provided in the ink introducing mechanism 50. If the cartridge 13 comes into contact with the corresponding cover portion 61 when a cartridge 13 is mounted on the cartridge mounting section 28, the cover portion 61 is moved in the −Y direction of the ink introducing portion 60 against the biasing force of the biasing member. Thus, the distal end in the +Y direction of the ink introducing portion 60 projects out in the +Y direction from the cover portion 61. As the projecting portion enters the inside of the cartridge 13, the ink introducing mechanism 50 is in a state where the ink in the cartridge 13 can be introduced into the liquid ejection device 12.

Each ink pressurizing portion 51 supplies the pressurized air for ink pressurization to the corresponding cartridge 13. Each ink pressurizing portion 51 is located in a region on the −Z direction side with respect to the corresponding cover portion 61. The ink pressurizing portions 51 are tubular protrusions extending in the +Y direction. An annular seal member is disposed on the inner peripheral surface of each ink pressurizing portion 51. The seal member is a member having elasticity, and is made of, for example, rubber. When the ink fluid circulating portion 116 shown in FIG. 5 of the corresponding cartridge 13 is inserted into each ink pressurizing portion 51, the ink pressurizing portion 51 is airtightly connected to the corresponding cartridge 13.

Each first device-side positioning portion 52 is located in a region on the +Z direction side with respect to the corresponding cover portion 61. The first device-side positioning portions 52 are protrusions that projecting in the +Y direction from the device-side end wall portion 41, and have, for example, a columnar shape. In each slot 48, the first device-side positioning portion 52 has a distal end at a position advanced in the +Y direction from the ink pressurizing portion 51, the first air supplying portion 56, the second air supplying portion 57, and the ink introducing portion 60. Furthermore, each first device-side positioning portion 52 has a distal end at a position advanced in the +Y direction from the device-side terminals included in the corresponding device-side terminal portion 55.

Each second device-side positioning portion 53 is located in a region on the −Z direction side with respect to the corresponding cover portion 61 and ink pressurizing portion 51. The second device-side positioning portions 53 are columnar protrusions projecting out from the device-side end wall portion 41 in the +Y direction. In each slot 48, the second device-side positioning portion 53 has a distal end at a position advanced in the +Y direction from the ink pressurizing portion 51, the first air supplying portion 56, the second air supplying portion 57, and the ink introducing portion 60, similar to the first device-side positioning portion 52. Each second device-side positioning portion 53 has a distal end at a position advanced in the +Y direction from the device-side terminals included in the corresponding device-side terminal portion 55.

In each slot 48, the first device-side positioning portion 52 and the second device-side positioning portion 53 perform positioning of the cartridge 13 in the mounting process, that is, in the process of mounting the cartridge 13 on the cartridge mounting section 28. Specifically, the first device-side positioning portion 52 and the second device-side positioning portion 53 perform positioning of the cartridge 13 in a direction intersecting the −Y direction, which is the mounting direction of the cartridge 13. The first and second device-side positioning portions 52 and 53 align the cartridge 13 with respect to the ink introducing portion 60, the ink pressurizing portion 51, the first air supplying portion 56, and the second air supplying portion 57.

Each device-side restricting portion 54 restricts displacement of the cartridge 13 in a mounted state in which the corresponding cartridge 13 is mounted on the cartridge mounting section 28. Each device-side restricting portion 54 has a pin 62 extending in the +Z direction at the distal end of a portion extending in the +Y direction from the device-side end wall portion 41. Each device-side restricting portion 54 engages with the corresponding cartridge 13 through the pin 62. The cartridge 13 in the mounted state receives a pressing force toward the +Y direction from the biasing member that biases the cover portion 61. The device-side restricting portion 54 restricts the cartridge 13 from being displaced in the +Y direction by the pressing force.

The pressurized air for stirring the ink in the cartridge 13 in the mounted state flows to the first air supplying portion 56. The first air supplying portion 56 is a tubular protrusion that extends in the +Y direction from the device-side end wall portion 41. The pressurized air is supplied to the first air supplying portion 56 through the second branch passage 36*b*.

The pressurized air for stirring the ink container 100 of the cartridge 13 flows to the second air supplying portion 57. The second air supplying portion 57 is a tubular protrusion that extends in the +Y direction from the device-side end wall portion 41. The pressurized air is supplied to the second air supplying portion 57 through the third branch passage 36*c*.

Figure 3:
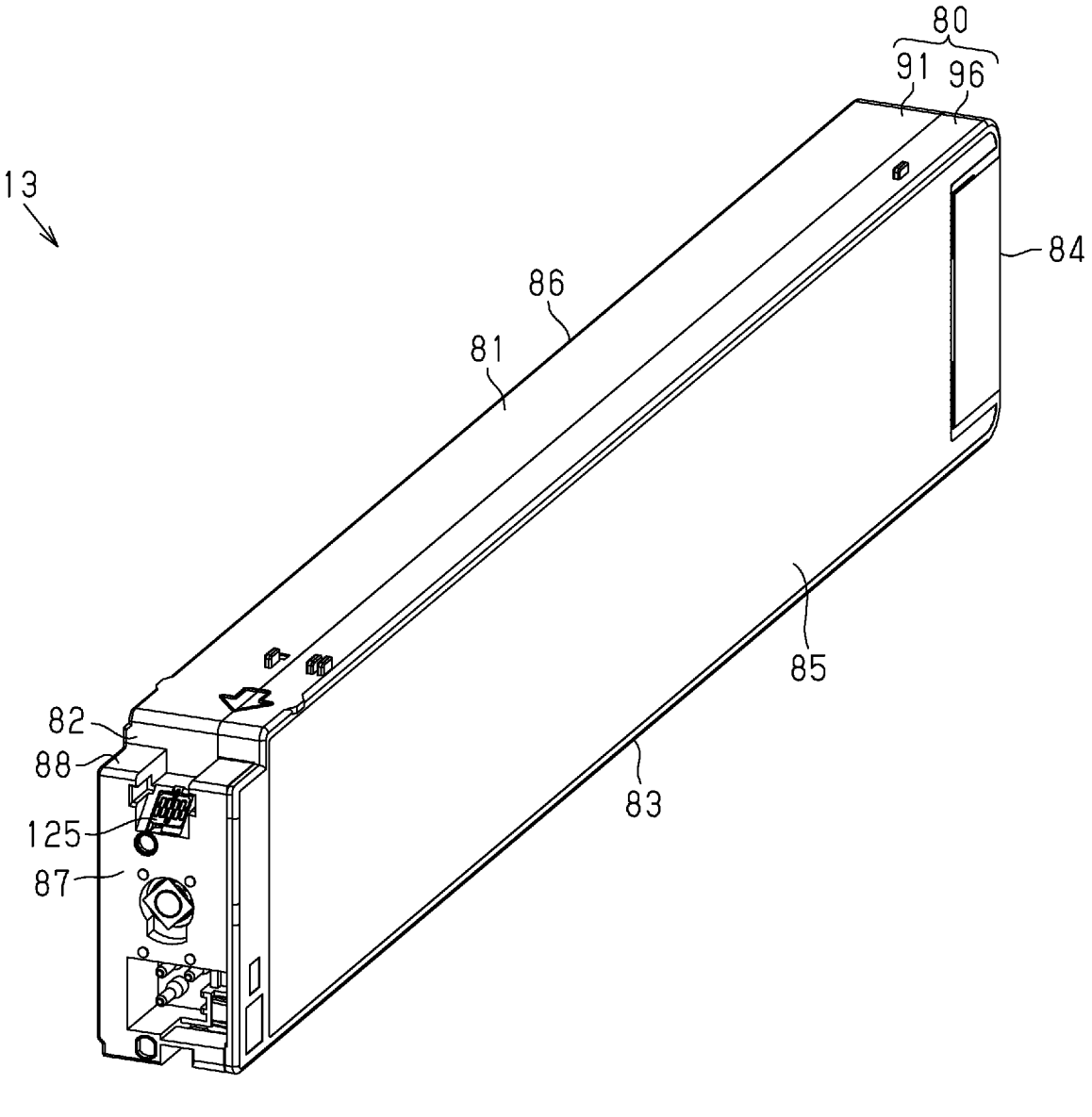
FIG. 3 is a perspective view showing a different cartridge including an airbag.
Figure 4:
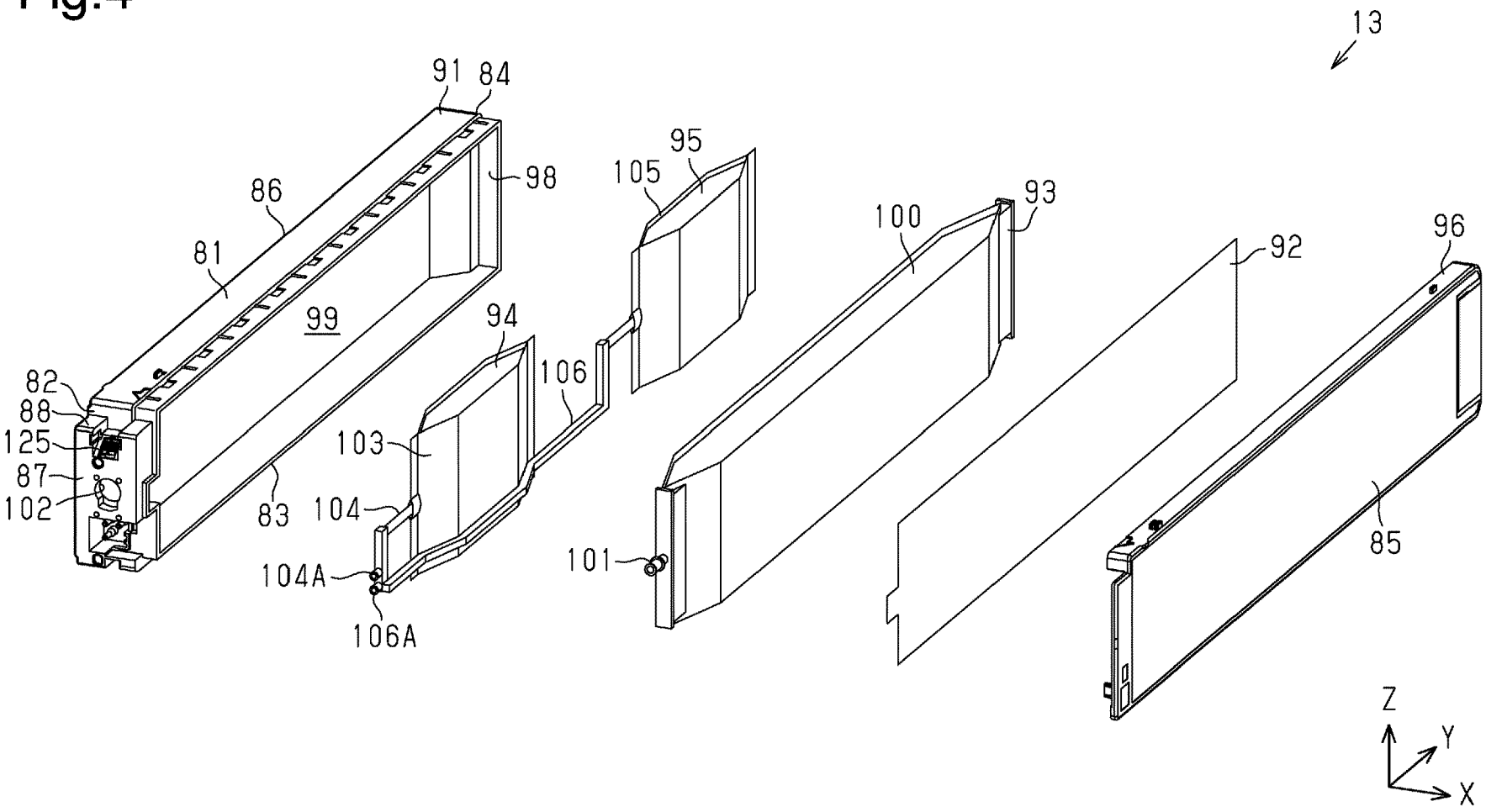
FIG. 4 is an exploded perspective view showing the different cartridge of FIG. 3.
Figure 5:
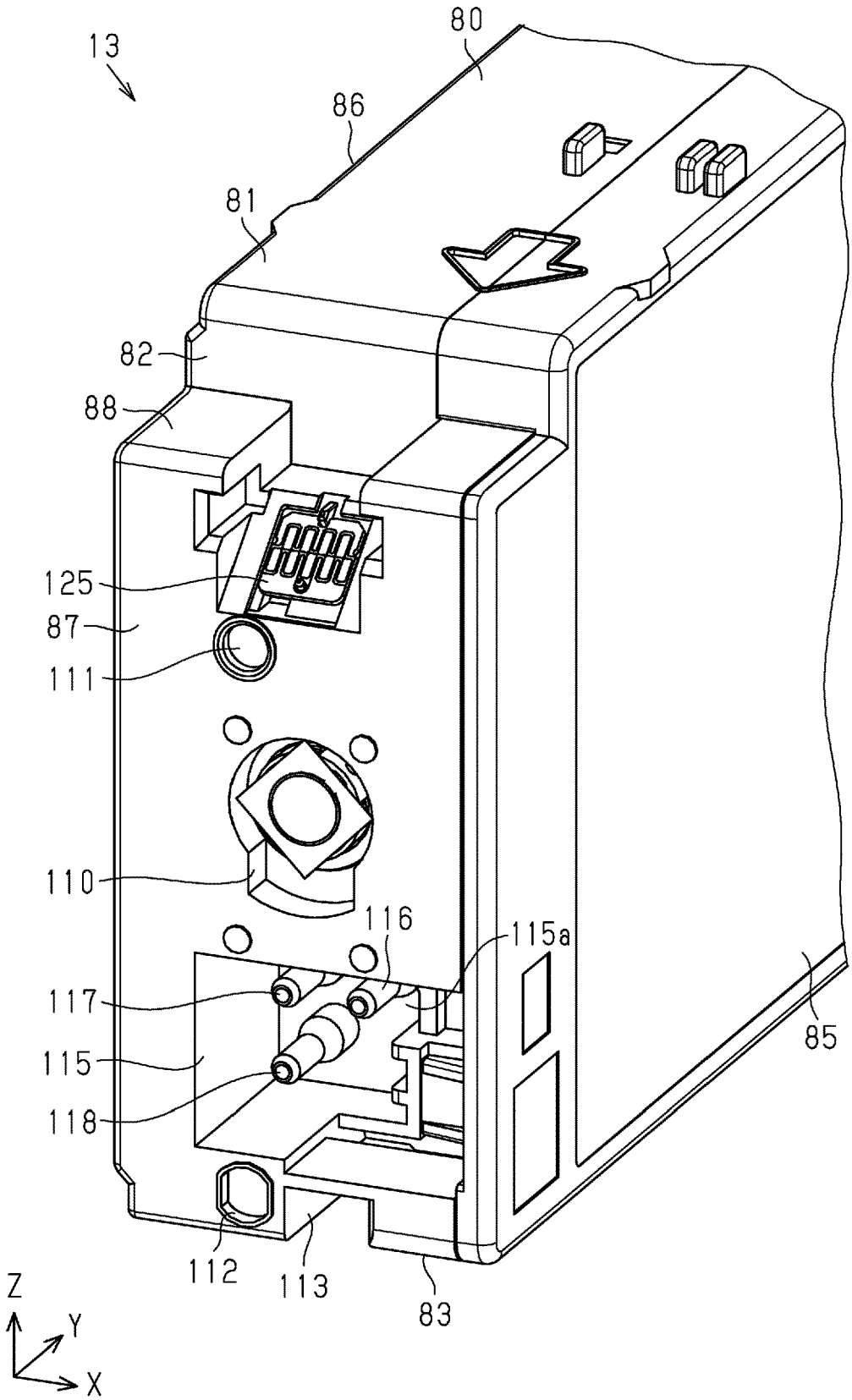
FIG. 5 is a perspective view showing a front wall side of the different cartridge of FIG. 3.

With reference to FIGS. 3, 4, and 5, the different cartridge 13 including an airbag that is mountable on the cartridge mounting section 28 will be described. The X axis, Y axis, and Z axis of FIGS. 3, 4, and 5 indicate the direction of the cartridge 13 in a state of being mounted on the cartridge mounting section 28.

As shown in FIG. 3, the cartridge 13 includes a case 80. The case 80 has a substantially rectangular parallelepiped outer shape in which a dimension (width) along the X axis is smaller than a dimension (height) along the Z axis and a dimension (height) along the Z axis is smaller than a dimension (depth) along the Y axis. The case 80 includes a first wall 81, a second wall 82, a third wall 83, a fourth wall 84, a fifth wall 85, and a sixth wall 86. The first wall 81 and the third wall 83 extend along the X axis and the Y axis. The first wall 81 is an end wall in the +Z direction of the case 80, and the third wall 83 is an end wall in the −Z direction of the case 80. The second wall 82 and the fourth wall 84 extend along the X axis and the Z axis. The second wall 82 is an end wall in the −Y direction of the case 80, and the fourth wall 84 is an end wall in the +Y direction of the case 80. The fifth wall 85 and the sixth wall 86 extend along the Y axis and the Z axis. The fifth wall 85 is an end wall in the +X direction of the case 80, and the sixth wall 86 is an end wall in the −X direction of the case 80.

The case 80 includes an end wall (front wall) 87 and a terminal arrangement wall portion 88 in addition to the first to sixth walls 81 to 86 described above. The end wall 87 extends along the X axis and the Z axis. The end wall 87 is located in a region on the −Y direction side with respect to the second wall 82. The end wall 87 is connected to the ends in the −Y direction of the third wall 83, the fifth wall 85, and the sixth wall 86. The terminal arrangement wall portion 88 connects the end in the +Z direction of the end wall 87 and the second wall 82. The terminal arrangement wall portion 88 is located in a region on the −Z direction side with respect to the first wall 81. The circuit board 125 is arranged on the terminal arrangement wall portion 88. The circuit board 125 has a cartridge-side terminal. The cartridge-side terminal is electrically connected to each of the device-side terminals of the device-side terminal portion 55 when the cartridge 13 is mounted.

As shown in FIG. 4, the cartridge 13 includes a first case member 91, a sealing member 92, an ink containing portion 93, a first stirring portion 94, a second stirring portion 95, and a second case member 96. The case 80 includes the first case member 91 and the second case member 96. The first case member 91 and the second case member 96 may be manufactured by molding a synthetic plastic, for example, polypropylene or polystyrene.

The first case member 91 is a box body having an opening 98 that opens in the +X direction. The first case member 91 mainly includes a first wall 81, a second wall 82, a third wall 83, a fourth wall 84, a sixth wall 86, an end wall 87, and a terminal arrangement wall portion 88. The first case member 91 interiorly defines a pressurizing chamber 99.

The sealing member 92 seals the opening 98 of the first case member 91. The sealing member 92 is joined to the first case member 91 by, for example, welding or adhesion. The sealing member 92 is joined to the first case member 91 in a state where the first stirring portion 94, the second stirring portion 95, and the ink containing portion 93 are stored in the first case member 91.

The ink containing portion 93 is stored in the pressurizing chamber 99. The ink containing portion 93 includes an ink container 100 and an ink lead-out portion 101. The ink container 100 contains ink. The ink container 100 is a bag body at least partially having flexibility. The volume of the ink container 100 decreases with consumption of ink. The ink contained in the ink container 100 is led out to the liquid ejection device 12 through the ink lead-out portion 101. The ink lead-out portion 101 is connected to the end in the −Y direction of the ink container 100. The ink lead-out portion 101 is a cylindrical protrusion that extends in the −Y direction from a connecting portion with respect to the ink container 100. The ink lead-out portion 101 has an end in the −Y direction disposed outside the pressurizing chamber 99 through the lead-out opening 102 of the first case member 91. A valve mechanism is disposed inside the ink lead-out portion 101. In the mounting process of the cartridge 13, the valve mechanism is opened when the ink introducing portion 60 of the cartridge mounting section 28 is inserted into the ink lead-out portion 101. The ink lead-out portion 101 and the ink introducing portion 60 are thereby connected. The ink containing portion 93 is disposed so as to seal the lead-out opening 102. The ink container 100 is pressed by supplying pressurized air to the pressurizing chamber 99, so that the ink inside is pressurized. Thus, the ink is led out from the ink container 100 through the ink lead-out portion 101.

The first stirring portion 94 and the second stirring portion 95 are housed in the pressurizing chamber 99. The first stirring portion 94 and the second stirring portion 95 are located in a region on the −X direction side with respect to the ink container 100 so as to be adjacent to the ink container 100 along the X axis.

The first stirring portion 94 includes a first airbag 103 and a first fluid circulating passage 104. The first airbag 103 is a bag body having flexibility. The first airbag 103 is located in a region on the −Y direction side with respect to the second stirring portion 95 in the pressurizing chamber 99. The first fluid circulating passage 104 has a first end connected to the first airbag 103, and a second end 104A connected to a first stirring fluid circulating portion 117 shown in FIG. 5. The first stirring fluid circulating portion 117 is a part to which the first air supplying portion 56 is connected in the mounted state of the cartridge 13. The first airbag 103 is inflated when the pressurized air pressurized by the pressurizing pump 31 is supplied, and is deflated when the supply of the pressurized air by the pressurizing pump 31 is stopped. That is, as the first airbag 103 alternately repeats inflation and deflation with the circulation of pressurized air through the first fluid circulating passage 104, the first stirring portion 94 stirs the ink contained in the ink container 100.

The second stirring portion 95 includes a second airbag 105 and a second fluid circulating passage 106. The second airbag 105 is a bag body having flexibility. The second airbag 105 is located in a region on the +Y direction side with respect to the first stirring portion 94 in the pressurizing chamber 99. The second fluid circulating passage 106 has a first end connected to the second airbag 105 and a second end 106A. The second end 106A is connected to the second stirring fluid circulating portion 118 shown in FIG. 5 in the mounted state of the cartridge 13. The second stirring fluid circulating portion 118 is a part to which the second air supplying portion 57 is connected. The second airbag 105 is inflated when the pressurized air pressurized by the pressurizing pump 31 is supplied, and is deflated when the supply of the pressurized air by the pressurizing pump 31 is stopped. That is, as the second airbag 105 alternately repeats inflation and deflation with the circulation of pressurized air through the second fluid circulating passage 106, the second stirring portion 95 stirs the ink contained in the ink container 100.

The pressurized air is alternately supplied to the first stirring portion 94 and the second stirring portion 95. That is, the supply of pressurized air to the second stirring portion 95 is stopped when the pressurized air is being supplied to the first stirring portion 94. Furthermore, the supply of pressurized air to the first stirring portion 94 is stopped when the pressurized air is being supplied to the second stirring portion 95. Through such stirring of ink, the pigment particles that settled in the ink container 100 flow, and variations in the concentration distribution of the pigment particles in the ink in the ink container 100 are reduced.

The second case member 96 is attached to the first case member 91 so as to cover the sealing member 92. The second case member 96 mainly has a fifth wall 85. The first case member 91 and the second case member 96 protect the first stirring portion 94, the second stirring portion 95, the ink container 100, and the sealing member 92.

As shown in FIG. 5, the cartridge 13 includes a lead-out space forming portion 110, a first cartridge-side positioning portion 111, a second cartridge-side positioning portion 112, and a cartridge-side restricting portion 113.

The lead-out space forming portion 110 defines a space in which the ink lead-out portion 101 of the ink containing portion 93 is arranged. The lead-out space forming portion 110 is a recess opened at the center along the Z axis and the X axis in the end wall 87. The lead-out space forming portion 110 includes a peripheral wall extending in the +Y direction from the end wall 87, and a lead-out opening 102 defined by an end edge in the +Y direction of the peripheral wall.

The first cartridge-side positioning portion 111 is located in a region on the +Z direction side with respect to the lead-out space forming portion 110. The first cartridge-side positioning portion 111 is a circular hole that passes through the end wall 87 in the +Y direction. In the mounting process of the cartridge 13, the first device-side positioning portion 52 of the cartridge mounting section 28 is inserted into the first cartridge-side positioning portion 111.

The second cartridge-side positioning portion 112 is located in a region on the −Z direction side with respect to the lead-out space forming portion 110. The second cartridge-side positioning portion 112 is a long hole that passes through the end wall 87 in the +Y direction. This long hole is a vertically long hole which dimension along the Z axis is longer than the dimension along the X axis. In the mounting process of the cartridge 13, the second device-side positioning portion 53 of the cartridge mounting section 28 is inserted into the second cartridge-side positioning portion 112.

In the mounting process of the cartridge 13, when the cartridge 13 is moved in the −Y direction, which is the mounting direction, the distal ends of the first and second device-side positioning portions 52 and 53 are inserted into the first and second cartridge-side positioning portions 111 and 112, respectively. Thereafter, displacement of the cartridge 13 in the direction intersecting the mounting direction is limited, and the cartridge 13 is moved in the mounting direction while being guided by the first and second device-side positioning portions 52 and 53. At this time, the second cartridge-side positioning portion 112, which is a vertically long hole, easily allows for manufacturing tolerance of the cartridge mounting section 28 and the cartridge 13 while restricting displacement of the cartridge 13 in a direction intersecting the mounting direction. In the mounting process of the cartridge 13, the ink lead-out portion 101 is aligned with the ink introducing portion 60 by positioning using the first device-side positioning portion 52, the second device-side positioning portion 53, the first cartridge-side positioning portion 111, and the second cartridge-side positioning portion 112.

The cartridge-side restricting portion 113 is located in a region on the −Z direction side with respect to the second cartridge-side positioning portion 112. The cartridge-side restricting portion 113 is a groove portion of the third wall 83, and is opened to the end wall 87. The cartridge-side restricting portion 113 is disposed so as to engage with the pin 62 of the device-side restricting portion 54. The pin 62 of the device-side restricting portion 54 moves in the cartridge-side restricting portion 113 during the mounting process of the cartridge 13. The pin 62 restricts displacement of the cartridge 13 by engaging with the cartridge-side restricting portion 113 in the mounted state of the cartridge 13. The engagement between the pin 62 and the cartridge-side restricting portion 113 is released by pushing the cartridge 13 in the mounted state in the −Y direction, so that the cartridge 13 can be detached from the cartridge mounting section 28. In the process of detaching the cartridge 13 from the cartridge mounting section 28, the pin 62 of the device-side restricting portion 54 moves in the cartridge-side restricting portion 113, and then separates from the cartridge-side restricting portion 113.

As shown in FIG. 5, the cartridge 13 has a recess 115, an ink fluid circulating portion 116, a first stirring fluid circulating portion 117, and a second stirring fluid circulating portion 118.

The recess 115 is located in a region on the −Z direction side with respect to the lead-out space forming portion 110 and a region on the +Z direction side with respect to the second cartridge-side positioning portion 112. The recess 115 is a substantially rectangular recess opened to the end wall 87, and includes a side wall extending from the opening in the +Y direction and a bottom wall 115*a*.

The pressurized air for pressurizing the ink flowing through the ink fluid circulating portion 116 is supplied to the pressurizing chamber 99. The ink fluid circulating portion 116 is a tubular protrusion that extends in the −Y direction from the bottom wall 115*a* in the recess 115. The pressurizing chamber 99 communicates with the outside of the cartridge 13 through the ink fluid circulating portion 116. The ink fluid circulating portion 116 is air-tightly connected with the ink pressurizing portion 51 by being inserted to the inner side of the annular seal member of the ink pressurizing portion 51.

In the mounting process of the cartridge 13, the ink fluid circulating portion 116 is aligned with the ink pressurizing portion 51 by positioning using the first device-side positioning portion 52, the second device-side positioning portion 53, the first cartridge-side positioning portion 111, and the second cartridge-side positioning portion 112.

The pressurized air circulating through the first stirring fluid circulating portion 117 is used for stirring the ink by the first stirring portion 94. The first stirring fluid circulating portion 117 is a tubular protrusion extending in the −Y direction from the bottom wall 115*a* of the recess 115 in the recess 115. The first fluid circulating passage 104 communicates with the outside of the cartridge 13 through the first stirring fluid circulating portion 117. The first stirring fluid circulating portion 117 is airtightly connected to the first air supplying portion 56 by being inserted to the inner side of the annular seal member 119 of the first air supplying portion 56 shown in FIGS. 6 and 7. The pressurized air supplied through the first air supplying portion 56 by driving the pressurizing pump 31 is introduced into the first fluid circulating passage 104 through the first stirring fluid circulating portion 117. The pressurized air discharged from the first airbag 103 when the pressurizing pump 31 is stopped is led out from the first fluid circulating passage 104 through the first stirring fluid circulating portion 117.

In the mounting process of the cartridge 13, the first stirring fluid circulating portion 117 is aligned with the first air supplying portion 56 by positioning using the first device-side positioning portion 52, the second device-side positioning portion 53, the first cartridge-side positioning portion 111, and the second cartridge-side positioning portion 112.

The pressurized air circulating through the second stirring fluid circulating portion 118 is used for stirring the ink by the second stirring portion 95. The second stirring fluid circulating portion 118 is a tubular protrusion extending in the −Y direction from the bottom wall 115*a* of the recess 115 in the recess 115. The second fluid circulating passage 106 communicates with the outside of the cartridge 13 through the second stirring fluid circulating portion 118. The second stirring fluid circulating portion 118 is airtightly connected to the second air supplying portion 57 by being inserted to the inner side of the annular seal member 120 of the second air supplying portion 57 shown in FIGS. 6 and 7. When the pressurizing pump 31 is driven, the pressurized air is supplied to the cartridge 13 through the second air supplying portion 57. The pressurized air is introduced into the second fluid circulating passage 106 through the second stirring fluid circulating portion 118. When the pressurizing pump 31 is stopped, the pressurized air is discharged from the second airbag 105. The pressurized air is led out from the second fluid circulating passage 106 through the second stirring fluid circulating portion 118.

In the mounting process of the cartridge 13, the second stirring fluid circulating portion 118 is aligned with the second air supplying portion 57 by positioning using the first device-side positioning portion 52, the second device-side positioning portion 53, the first cartridge-side positioning portion 111, and the second cartridge-side positioning portion 112.

A cartridge 130 not including the airbag that is mountable on the cartridge mounting section 28 will be described with reference to FIGS. 6 and 7. The cartridge 130 has a structure portion common with the cartridge 13. Therefore, the cartridge 130 will be described with respect to parts different from the cartridge 13, and the same parts as those of the cartridge 13 are denoted with the same reference numerals, and detailed description thereof will be omitted. The cartridge 130 not including an airbag is different from the different cartridge 13 including an airbag in that the first and second airbags 103 and 105, the first stirring portion 94, and the second stirring portion 95 are not provided.

As described above, in the liquid ejection system 11, an error is detected and the notification section 40 is driven when both the second pressure and the third pressure do not satisfy the appropriate conditions. Therefore, the cartridge 130 not including an airbag requires a structure that limits leakage of pressurized air supplied by the first air supplying portion 56 and the second air supplying portion 57, and satisfies appropriate conditions for both the second pressure and the third pressure.

Figure 6:
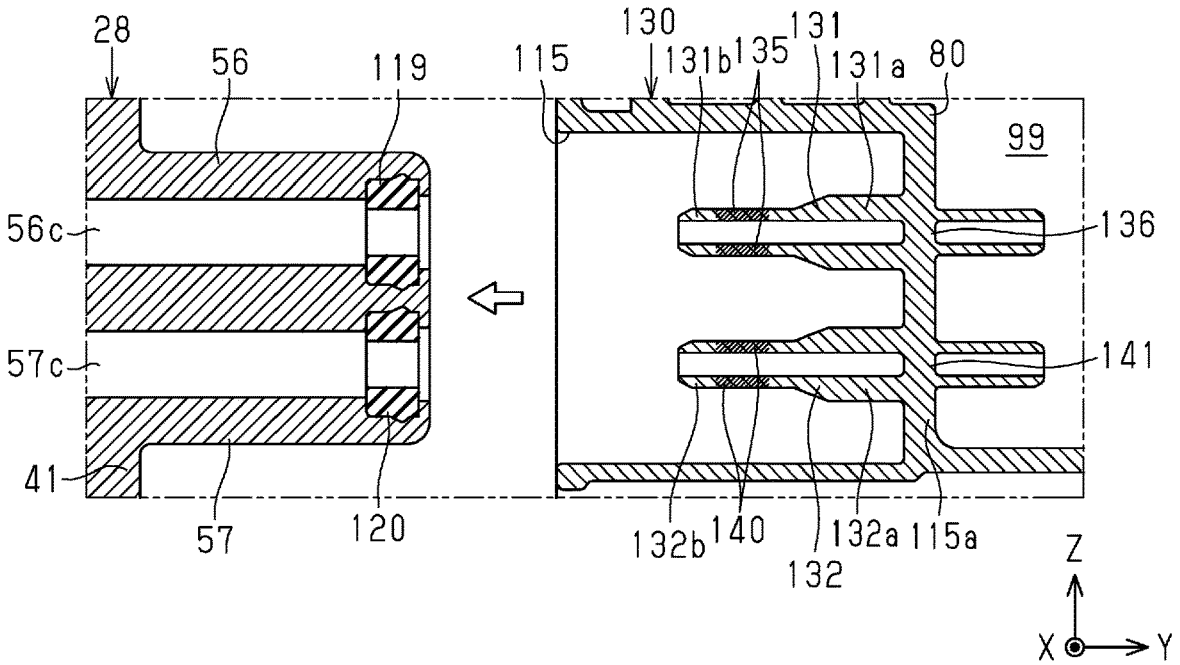
FIG. 6 is a cross-sectional view showing a state immediately before a cartridge not including an airbag is mounted on the cartridge mounting section in the first embodiment.
Figure 7:
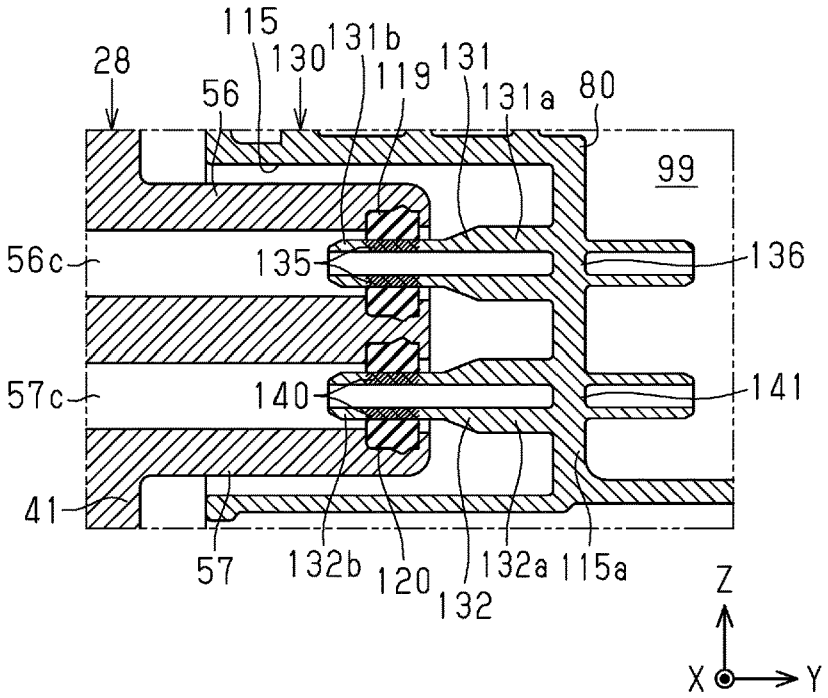
FIG. 7 is a cross-sectional view showing a state in which the cartridge of FIG. 6 is mounted on the cartridge mounting section.

As shown in FIGS. 6 and 7, the cartridge 130 includes a first communication portion 131 and a second communication portion 132. The first communication portion 131 is integrally connected to the case 80. The first communication portion 131 is a tubular protrusion extending from the bottom wall 115*a* of the recess 115 in the −Y direction, which is the mounting direction of the cartridge 130. The first communication portion 131 includes a first large diameter portion 131*a* extending from the proximal end and a first small diameter portion 131*b* connected to the distal end. The first small diameter portion 131*b* is inserted to the inner side of the seal member 119 through the air supplying passage 56*c*of the first air supplying portion 56, whereby the first communication portion 131 is airtightly connected to the first air supplying portion 56 in an airtight manner. That is, the seal member 119 seals the gap between the peripheral wall of the first air supplying portion 56 and the peripheral wall of the first communication portion 131 in the mounted state of the cartridge 130. When the first communication portion 131 is connected to the first air supplying portion 56, the internal space of the first communication portion 131 communicates with the air supplying passage 56*c*of the first air supplying portion 56. Of the peripheral wall of the first small diameter portion 131*b*, a first contact portion 135 that comes into contact with the seal member 119 is a first leakage limiting portion corresponding to the first air supplying portion 56. The first leakage limiting portion limits leakage of pressurized air to be supplied to the first air supplying portion 56 into the atmosphere. In FIGS. 6 and 7, the portion corresponding to the first contact portion 135 is indicated by cross hatching. When the first communication portion and the second communication portion do not need to be distinguished, they are simply referred to as communication portion.

The first communication portion 131 has a first partition wall 136. The first partition wall 136 separates the pressurizing chamber 99 which is the space on the inner side of the case 80 and the space on the outer side of the case 80 from each other. The first partition wall 136 is a second leakage limiting portion corresponding to the first air supplying portion 56. The first partition wall 136 prevents the pressurized air supplied from the first air supplying portion 56 from flowing into the pressurizing chamber 99 through the first communication portion 131 in the mounted state of the cartridge 130. That is, the first partition wall 136 prevents the pressurized air supplied from the first air supplying portion 56 from leaking out to the pressurizing chamber 99 through the first communication portion 131.

The second communication portion 132 is integrally coupled to the case 80. The second communication portion 132 is a tubular protrusion extending from the bottom wall 115*a* of the recess 115 in the −Y direction, which is the mounting direction of the cartridge 130. The second communication portion 132 includes a second large diameter portion 132*a* extending from the proximal end and a second small diameter portion 132*b* connected to the distal end. The second communication portion 132 is airtightly connected to the second air supplying portion 57 by inserting the second small diameter portion 132*b* to the inner side of the seal member 120 through the air supplying passage 57*c* of the second air supplying portion 57. That is, the seal member 120 seals the gap between the peripheral wall of the second air supplying portion 57 and the peripheral wall of the second communication portion 132 in the mounted state of the cartridge 130. When the second communication portion 132 is connected to the second air supplying portion 57, the internal space of the second communication portion 132 communicates with the air supplying passage 57*c* of the second air supplying portion 57. Of the peripheral wall of the second small diameter portion 132*b*, a second contact portion 140 that comes into contact with the seal member 119 is a first leakage limiting portion corresponding to the second air supplying portion 57. The first leakage limiting portion limits leakage of pressurized air to be supplied to the second air supplying portion 57 into the atmosphere. In FIGS. 6 and 7, a portion corresponding to the second contact portion 140 is indicated by cross hatching.

The second communication portion 132 has a second partition wall 141. The second partition wall 141 separates the pressurizing chamber 99 which is the space on the inner side of the case 80 and the space on the outer side of the case 80 from each other. The second partition wall 141 is a second leakage limiting portion corresponding to the second air supplying portion 57. The second leakage limiting portion limits flow of the pressurized air supplied by the second air supplying portion 57 into the pressurizing chamber 99 through the second communication portion 132 in the mounted state of the cartridge 130. That is, the second partition wall 141 limits leakage of the pressurized air supplied from the second air supplying portion 57 to the pressurizing chamber 99 through the second communication portion 132.

The operation and the advantages of the first embodiment will now be described.

(1) The cartridge 130 includes the first contact portion 135, and the first contact portion 135 cooperates with the seal member 119 of the first air supplying portion 56 in the mounted state to limit leakage of pressurized air supplied by the first air supplying portion 56 into the atmosphere. The cartridge 130 includes a first partition wall 136, and the first partition wall 136 limits leakage of pressurized air supplied by the first air supplying portion 56 into the pressurizing chamber 99 when in the mounted state.

The cartridge 130 includes the second contact portion 140, and the second contact portion 140 cooperates with the seal member 120 of the second air supplying portion 57 in the mounted state to limit leakage of pressurized air supplied by the second air supplying portion 57 into the atmosphere. The cartridge 130 includes a second partition wall 141, and the second partition wall 141 limits leakage of pressurized air supplied by the second air supplying portion 57 into the pressurizing chamber 99 when in the mounted state.

Therefore, when pressurized air is supplied from the pressurizing mechanism 29 to the first air supplying portion 56 and the second air supplying portion 57, each of the second pressure and the third pressure easily satisfies the appropriate condition. Thus, errors caused by the second pressure or the third pressure are reduced. As a result, even if a cartridge 130 not including an airbag is mounted on the liquid ejection device 12 to which the different cartridge 13 including an airbag is mountable, errors are unlikely to occur.

(2) At the time of replacing the cartridge, the cartridge mounting method and the software for the liquid ejection device 12 to not need to be changed according to the presence or absence of the airbag. Therefore, the cartridge can be easily replaced.

Second Embodiment

A cartridge 148 and a liquid ejection system according to a second embodiment will be described with reference to FIGS. 8 and 9. The cartridge 148 not including an airbag and the liquid ejection system according to the second embodiment are different from the first embodiment in the structure of the connecting portion between the cartridge and the air supplying portion. Therefore, in the second embodiment, parts different from the first embodiment will be described, and the same parts will be denoted by the same reference numerals and detailed description thereof will be omitted.

Figure 8:
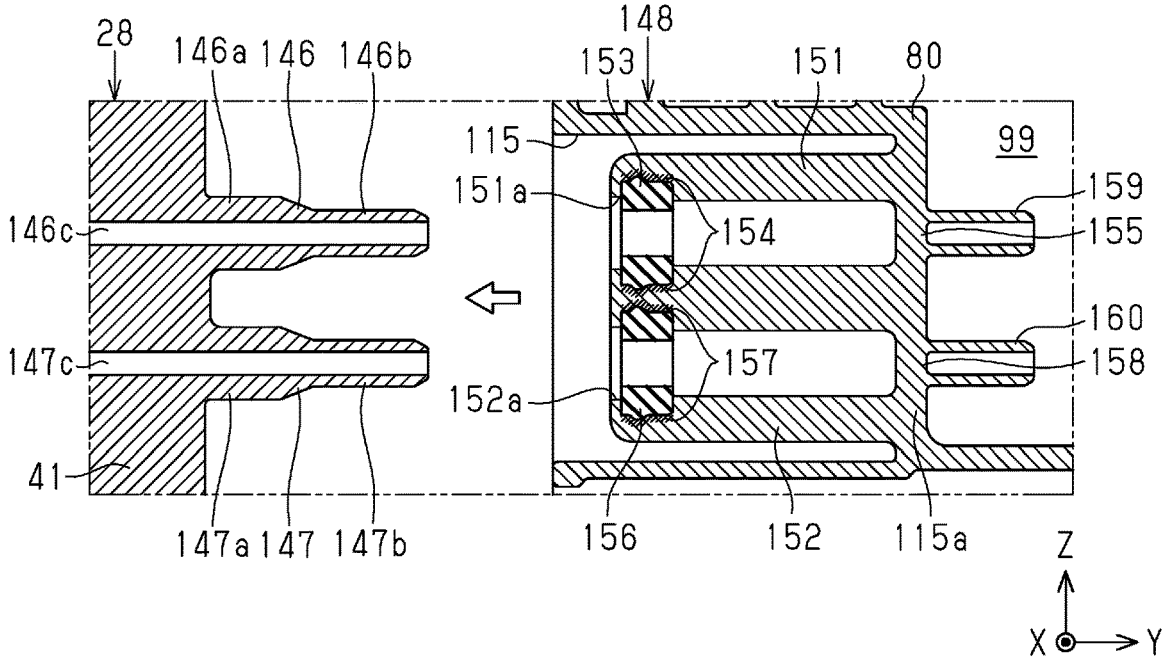
FIG. 8 is a cross-sectional view showing a state immediately before a cartridge not including an airbag is mounted on a cartridge mounting section according to a second embodiment.
Figure 9:
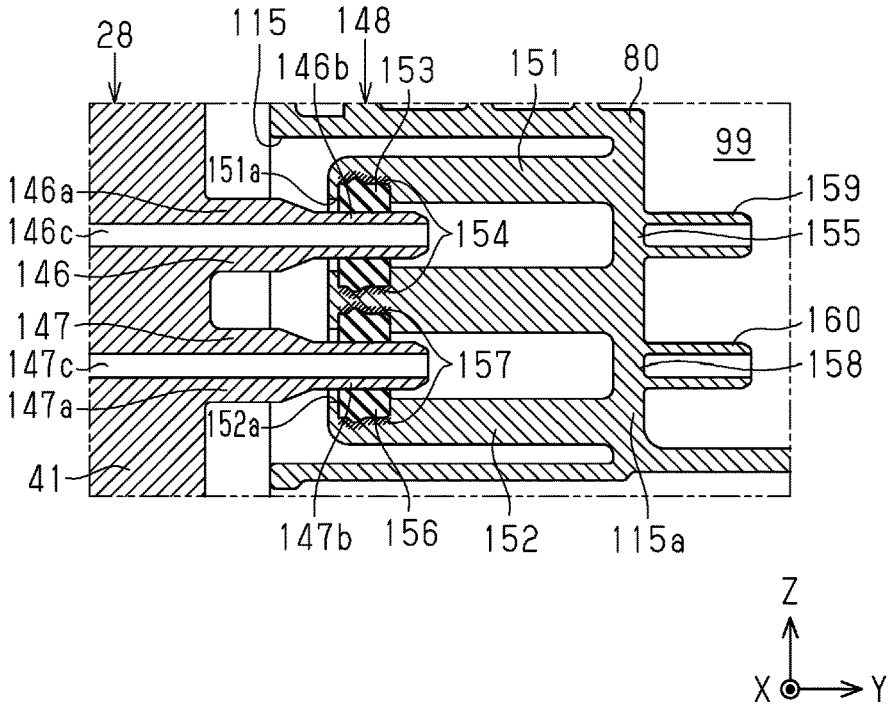
FIG. 9 is a cross-sectional view showing a state in which the cartridge of FIG. 8 is mounted on the cartridge mounting section.

As shown in FIGS. 8 and 9, the cartridge mounting section 28 includes a first air supplying portion 146 and a second air supplying portion 147. The first air supplying portion 146 is a tubular protrusion extending in the +Y direction from the device-side end wall portion 41. The first air supplying portion 146 includes a first large diameter portion 146*a* extending from the proximal end and a first small diameter portion 146*b* connected to the distal end. The second air supplying portion 147 is located in a region on the −Z direction side with respect to the first air supplying portion 146. The second air supplying portion 147 is a tubular protrusion extending in the +Y direction from the device-side end wall portion 41. The second air supplying portion 147 includes a second large diameter portion 147*a* extending from the proximal end and a second small diameter portion 147*b* connected to the distal end.

The cartridge 148 includes a first communication portion 151 and a second communication portion 152. The first communication portion 151 is a tubular protrusion extending in the −Y direction from the bottom wall 115*a* of the recess 115. The second communication portion 152 is located in a region on the −Z direction side with respect to the first communication portion 151. The second communication portion 152 is a tubular protrusion extending in the −Y direction from the bottom wall 115*a* of the recess 115.

When the first small diameter portion 146*b* of the first air supplying portion 146 is inserted from the distal end port 151*a*, the first communication portion 151 is connected to the first air supplying portion 146. An annular first seal member 153 is disposed on the inner peripheral surface of the distal end portion of the first communication portion 151.

The first seal member 153 is a member having elasticity, and is made of, for example, rubber. The first seal member 153 seals the gap between the peripheral wall of the first air supplying portion 146 and the peripheral wall of the first communication portion 151. When the first communication portion 151 is connected to the first air supplying portion 146, the internal space of the first communication portion 151 communicates with the air supplying passage 146*c* of the first air supplying portion 146.

In the cartridge 148, the first leakage limiting portion corresponding to the first air supplying portion 146 includes a first seal member 153 and a first supporting portion 154. The first supporting portion 154 is a portion that supports the first seal member 153 in the peripheral wall of the first communication portion 151. In FIGS. 8 and 9, the portion corresponding to the first supporting portion 154 is indicated by cross hatching.

The first communication portion 151 has a first partition wall 155 The first partition wall 155 separates the pressurizing chamber 99 which is a space on the inner side of the case 80 and a space on the outer side of the case 80 from each other. The first partition wall 155 is a second leakage limiting portion corresponding to the first air supplying portion 146. The first partition wall 155 limits flow of the pressurized air supplied from the first air supplying portion 146 into the pressurizing chamber 99 through the first communication portion 151 in the mounted state of the cartridge 148.

When the second small diameter portion 147*b* of the second air supplying portion 147 is inserted from the distal end port 152*a*, the second communication portion 152 is connected to the second air supplying portion 147. An annular second seal member 156 is disposed on the inner peripheral surface of the distal end portion of the second communication portion 152. The second seal member 156 is a member having elasticity, and is made of, for example, rubber. The second seal member 156 seals the gap between the peripheral wall of the second air supplying portion 147 and the peripheral wall of the second communication portion 152. When the second communication portion 152 is connected to the second air supplying portion 147, the internal space of the second communication portion 152 communicates with the air supplying passage 147*c* of the second air supplying portion 147.

In the cartridge 148, the first leakage limiting portion corresponding to the second air supplying portion 147 includes a second seal member 156 and a second supporting portion 157. The second supporting portion 157 is a portion that supports the second seal member 156 in the peripheral wall of the second communication portion 152. In FIGS. 8 and 9, the portion corresponding to the second supporting portion 157 is indicated by cross hatching.

The second communication portion 152 has a second partition wall 158 The second partition wall 158 separates the pressurizing chamber 99 which is a space on the inner side of the case 80 and a space on the outer side of the case 80 from each other. The second partition wall 158 is a second leakage limiting portion corresponding to the second air supplying portion 147. The second partition wall 158 limits flow of the pressurized air supplied from the second air supplying portion 147 into the pressurizing chamber 99 through the second communication portion 152 in the mounted state of the cartridge 148.

The different cartridge 13 including the first and second airbags 103 and 105 does not include the first partition wall 155 or the second partition wall 158. The first inner tubular portion 159 is a tubular protrusion extending in the +Y direction from the bottom wall 115*a* in the pressurizing chamber 99. As the first fluid circulating passage 104 of the first stirring portion 94 is connected to the first inner tubular portion 159, the first communication portion 151 is used as the first stirring fluid circulating portion 117. The second inner tubular portion 160 is a tubular protrusion extending in the +Y direction from the bottom wall 115*a* in the pressurizing chamber 99. As the second fluid circulating passage 106 of the second stirring portion 95 is connected to the second inner tubular portion 160, the second communication portion 152 is used as the second stirring fluid circulating portion 118.

The operation and the advantages of the second embodiment will now be described.

(3) The cartridge 148 includes a first seal member 153 and a first supporting portion 154. The first seal member 153 and the first supporting portion 154 cooperate with the first air supplying portion 146 when in the mounted state to limit leakage of pressurized air supplied by the first air supplying portion 146 into the atmosphere. The cartridge 148 includes a first partition wall 136. The first partition wall 136 limits leakage of pressurized air supplied by the first air supplying portion 146 to the pressurizing chamber 99 when in the mounted state.

The cartridge 148 includes a second seal member 156 and a second supporting portion 157. The second seal member 156 and the second supporting portion 157 cooperate with the second air supplying portion 147 when in the mounted state to limit leakage of pressurized air supplied by the second air supplying portion 147 into the atmosphere. The cartridge 148 includes a second partition wall 158. The second partition wall 158 limits leakage of pressurized air supplied from the second air supplying portion 147 to the pressurizing chamber 99 when in the mounted state.

Therefore, when the pressurized air is supplied from the pressurizing mechanism 29 to the first air supplying portion 146 and the second air supplying portion 147, each of the second pressure and the third pressure easily satisfies the appropriate condition. Thus, errors caused by the second pressure or the third pressure are reduced. As a result, errors are unlikely to occur even if the cartridge 148 not including an airbag is mounted on the liquid ejection device 12 to which a different cartridge including an airbag is mountable.

Third Embodiment

A cartridge 163 and a liquid ejection system according to a third embodiment will be described with reference to FIGS. 10 and 11. The cartridge 163 not including an airbag and the liquid ejection system according to the third embodiment are different from the first embodiment in the structure of the connecting portion between the cartridge and the air supplying portion. Therefore, in the third embodiment, parts different from the first embodiment will be described, and the same parts will be denoted by the same reference numerals and detailed description thereof will be omitted.

Figure 10:
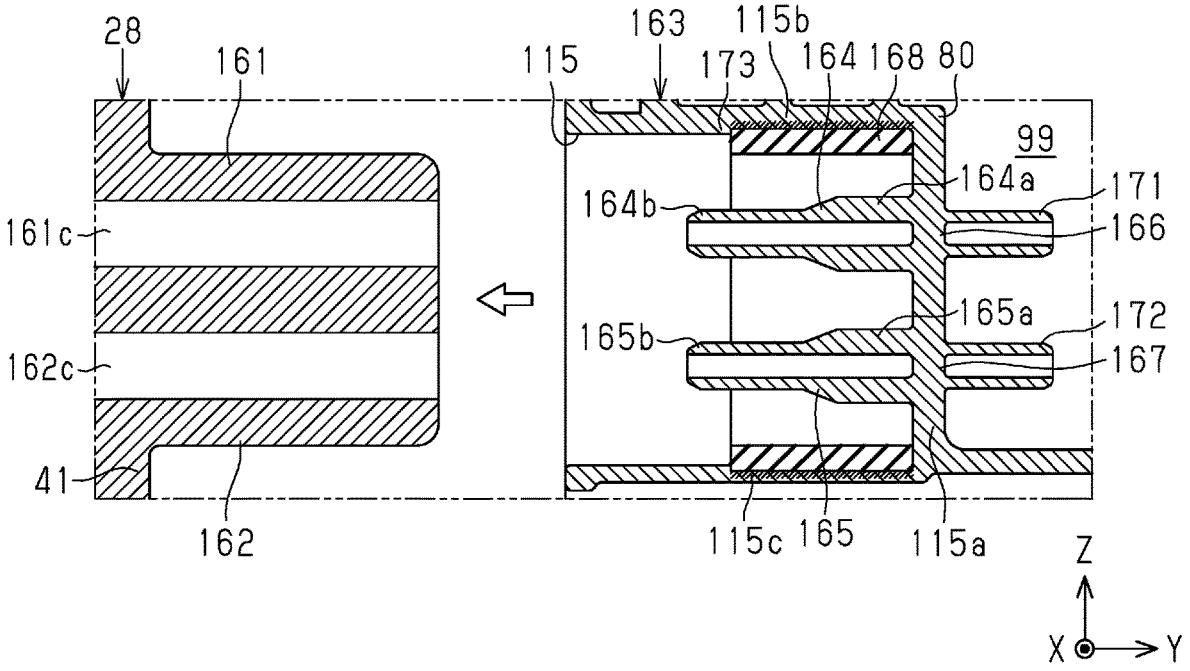
FIG. 10 is a cross-sectional view showing a state immediately before a cartridge not including an airbag is mounted on a cartridge mounting section in a third embodiment.
Figure 11:
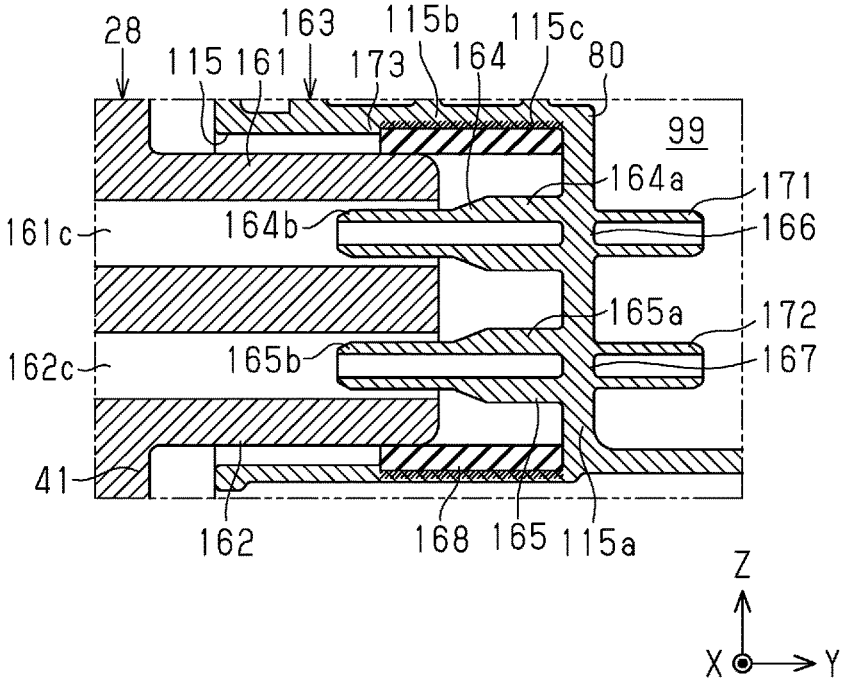
FIG. 11 is a cross-sectional view showing a state in which the cartridge of FIG. 10 is mounted on the cartridge mounting section.

As shown in FIGS. 10 and 11, the cartridge mounting section 28 includes a first air supplying portion 161 and a second air supplying portion 162. The first air supplying portion 161 is a tubular protrusion extending in the +Y direction from the device-side end wall portion 41. The second air supplying portion 162 is located in a region on the −Z direction side with respect to the first air supplying portion 161. The second air supplying portion 162 is a tubular protrusion extending in the +Y direction from the device-side end wall portion 41.

The cartridge 163 does not include an airbag. The cartridge 163 includes a first communication portion 164 and a second communication portion 165. The first communication portion 164 is a tubular protrusion extending in the −Y direction from the bottom wall 115*a* of the recess 115. The first communication portion 164 includes a first large diameter portion 164*a* extending from the proximal end and a first small diameter portion 164*b* connected to the distal end. The second communication portion 165 is located in a region on the −Z direction side with respect to the first communication portion 164. The second communication portion 165 is a tubular protrusion extending in the −Y direction from the bottom wall 115*a* of the recess 115. The second communication portion 165 includes a second large diameter portion 165*a* extending from the proximal end and a second small diameter portion 165*b* connected to the distal end.

When the first small diameter portion 164*b* is inserted into the air supplying passage 161*c* of the first air supplying portion 161, the first communication portion 164 is connected to the first air supplying portion 161. When the first communication portion 164 is connected to the first air supplying portion 161, the internal space of the first communication portion 164 communicates with the air supplying passage 161*c* of the first air supplying portion 161. The first communication portion 164 has a first partition wall 166 The first partition wall 166 separates the pressurizing chamber 99 which is a space on the inner side of the case 80 and a space on the outer side of the case 80 from each other. The first partition wall 166 is a second leakage limiting portion corresponding to the first air supplying portion 161. The first partition wall 166 limits flow of the pressurized air supplied by the first air supplying portion 161 into the pressurizing chamber 99 through the first communication portion 164 in the mounted state of the cartridge 163.

When the second small diameter portion 165*b* is inserted into the air supplying passage 162*c* of the second air supplying portion 162, the second communication portion 165 is connected to the second air supplying portion 162. When the second communication portion 165 is connected to the second air supplying portion 162, the internal space of the second communication portion 165 communicates with the air supplying passage 162*c* of the second air supplying portion 162. The second communication portion 165 has a second partition wall 167. The second partition wall 167 separates the pressurizing chamber 99 which is a space on the inner side of the case 80 and a space on the outer side of the case 80 from each other. The second partition wall 167 is a second leakage limiting portion corresponding to the second air supplying portion 162. The second partition wall 167 limits flow of the pressurized air supplied by the second air supplying portion 162 into the pressurizing chamber 99 through the second communication portion 165 in the mounted state of the cartridge 163.

The cartridge 163 includes a tubular seal member 168 to be fitted into the recess 115. The seal member 168 is a member having elasticity, and is made of, for example, rubber. The seal member 168 is formed by an injection molding method or the like. The outer peripheral surface of the seal member 168 is in contact with the side wall 115*b* of the recess 115. The outer peripheral surface of the seal member 168 may be joined to the side wall 115*b*. In the mounting process of the cartridge 163, the first air supplying portion 161 and the second air supplying portion 162 are airtightly inserted to the inner peripheral side of the seal member 168. The seal member 168 seals the gap between the first air supplying portion 161 and the side wall 115*b* of the recess 115 and the gap between the second air supplying portion 162 and the side wall 115*b* of the recess 115 in the mounted state of the cartridge 163. The leakage of pressurized air into the atmosphere is thereby limited. That is, the first leakage limiting portion includes the seal member 168 and a supporting portion 115*c* which is a portion of the side wall 115*b* that supports the seal member 168. In FIGS. 10 and 11, a portion corresponding to the supporting portion 115*c* is indicated by cross hatching.

The cartridge 163 may include a locking portion 173. The locking portion 173 is a stepped portion or a protrusion that limits movement of the seal member 168 in the −Y direction with respect to the case 80. The locking portion 173 is a portion that engages with the end in the −Y direction of the seal member 168 in the side wall 115*b* of the recess 115. This makes it difficult for the seal member 168 to fall out from the recess 115 when detaching the cartridge 163. The cartridge 163 does not necessarily need to have the locking portion 173 on the side wall 115*b* of the recess 115.

The different cartridge 13 including the first airbag and the second airbags 103 and 105 does not include the first partition wall 166 or the second partition wall 167. The first inner tubular portion 171 is a tubular protrusion extending in the +Y direction from the bottom wall 115*a* of the recess 115 in the pressurizing chamber 99. Since the first fluid circulating passage 104 of the first stirring portion 94 is connected to the first inner tubular portion 171, the first communication portion 164 is used as the first stirring fluid circulating portion 117. The second inner tubular portion 172 is a tubular protrusion extending in the +Y direction from the bottom wall 115*a* in the pressurizing chamber 99. Since the second fluid circulating passage 106 of the second stirring portion 95 is connected to the second inner tubular portion 172, the second communication portion 165 is used as the second stirring fluid circulating portion 118.

The operation and the advantages of the third embodiment will now be described.

(4) The cartridge 163 includes a seal member 168 and a supporting portion 115*c* that supports the seal member 168. The seal member 168 and the supporting portion 115*c* cooperate with the first air supplying portion 161 and the second air supplying portion 162 when in the mounted state to limit leakage of pressurized air into the atmosphere.

The cartridge 163 includes a first partition wall 166 and a second partition wall 167. The first partition wall 166 limits leakage of pressurized air supplied from the first air supplying portion 161 to the pressurizing chamber 99 when in the mounted state. The second partition wall 167 limits leakage of pressurized air supplied from the second air supplying portion 162 to the pressurizing chamber 99 when in the mounted state.

Therefore, when the pressurized air is supplied from the pressurizing mechanism 29 to the first air supplying portion 161 and the second air supplying portion 162, each of the second pressure and the third pressure easily satisfies the appropriate condition. As a result, errors due to the second pressure or the third pressure are reduced. As a result, errors are unlikely to occur even if the cartridge 163 not including an airbag is mounted on the liquid ejection device 12 to which a different cartridge including an airbag is mountable.

Fourth Embodiment

A cartridge 175 and a liquid ejection system according to a fourth embodiment will be described with reference to FIGS. 12 and 13. The cartridge 175 not including an airbag and the liquid ejection system according to a fourth embodiment are different from the third embodiment in that a seal member for sealing the gap between the first air supplying portion 161 and the side wall 115*b* of the recess 115, and the gap between the second air supplying portion 162 and the side wall 115*b* of the recess 115 is arranged in the cartridge mounting section 28. Therefore, in the fourth embodiment, parts different from the third embodiment will be described, and the same parts will be denoted by the same reference numerals and detailed description thereof will be omitted.

Figure 12:
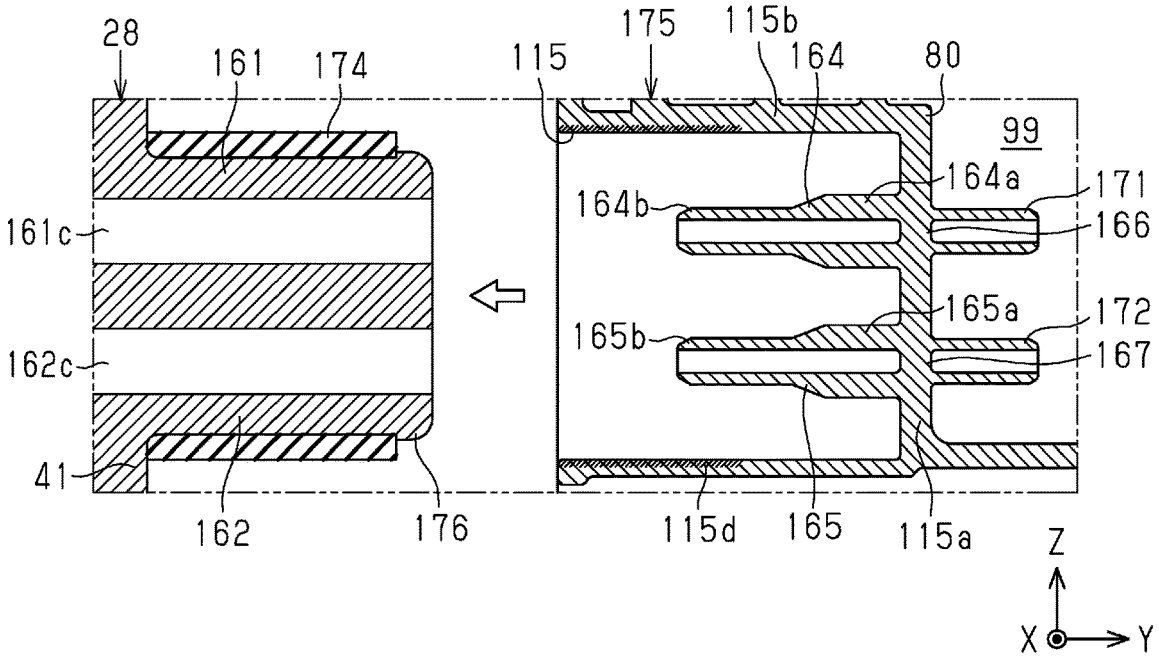
FIG. 12 is a cross-sectional view showing a state immediately before a cartridge not including an airbag is mounted on a cartridge mounting section according to a fourth embodiment.
Figure 13:
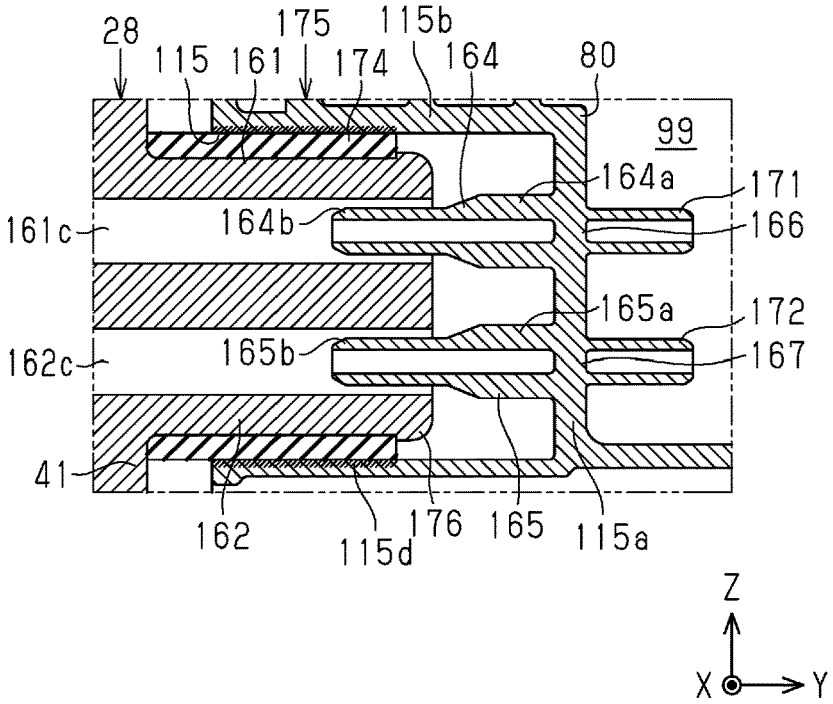
FIG. 13 is a cross-sectional view showing a state in which the cartridge of FIG. 12 is mounted on the cartridge mounting section.

As shown in FIGS. 12 and 13, the cartridge mounting section 28 includes a tubular seal member 174. The seal member 174 is disposed so as to surround the first air supplying portion 161 and the second air supplying portion 162. The seal member 174 is attached to the outer peripheral portions of the first air supplying portion 161 and the second air supplying portion 162. The seal member 174 may be joined to the outer peripheral portions of the first air supplying portion 161 and the second air supplying portion 162. The seal member 174 is a member having elasticity, and is made of, for example, rubber. The seal member 174 may be molded by an injection molding method. The seal member 174 has a shape that can be fitted into the recess 115. The seal member 174 seals the gap between the first air supplying portion 161 and the side wall 115*b* of the recess 115 and a gap between the second air supplying portion 162 and the side wall 115*b* of the recess 115 in the mounted state of the cartridge 175. In the cartridge 175, a contact portion 115*d* that comes into contact with the seal member 174 in the side wall 115*b* of the recess 115 is used as the first leakage limiting portion. In FIGS. 12 and 13, the contact portion 115*d* is indicated by cross hatching.

The first air supplying portion 161 and the second air supplying portion 162 have a locking portion 176. The locking portion 176 is a stepped portion or a larger diameter portion that limits movement of the seal member 174 in the +Y direction with respect to the device-side end wall portion 41. The locking portion 176 is a portion of the first air supplying portion 161 and the second air supplying portion 162 that engages with the end in the +Y direction of the seal member 174. Thus, the seal member 174 is unlikely to be detached from the first air supplying portion 161 and the second air supplying portion 162 when detaching the cartridge 175. The first air supplying portion 161 and the second air supplying portion 162 does not necessarily need to include the locking portion 176.

The operation and the advantages of the fourth embodiment will now be described.

(5) Thus, errors are unlikely to occur even if the cartridge 163 not including an airbag is mounted on the liquid ejection device 12 to which a different cartridge including an airbag is mountable.

(6) The seal member 174 is arranged in the cartridge mounting section 28. Since it is not necessary to attach the seal member 174 to each cartridge 175 which is a replacement part, the productivity of the cartridge 175 is enhanced.

Fifth Embodiment

A cartridge 180 and a liquid ejection system according to a fifth embodiment will be described with reference to FIGS. 14 and 15. The cartridge 180 not including an airbag and the liquid ejection system according to the fifth embodiment are different from the first embodiment in the configuration of the second leakage limiting portion. Therefore, in the fifth embodiment, parts different from the first embodiment will be described, and the same parts will be denoted by the same reference numerals and detailed description thereof will be omitted.

Figure 14:
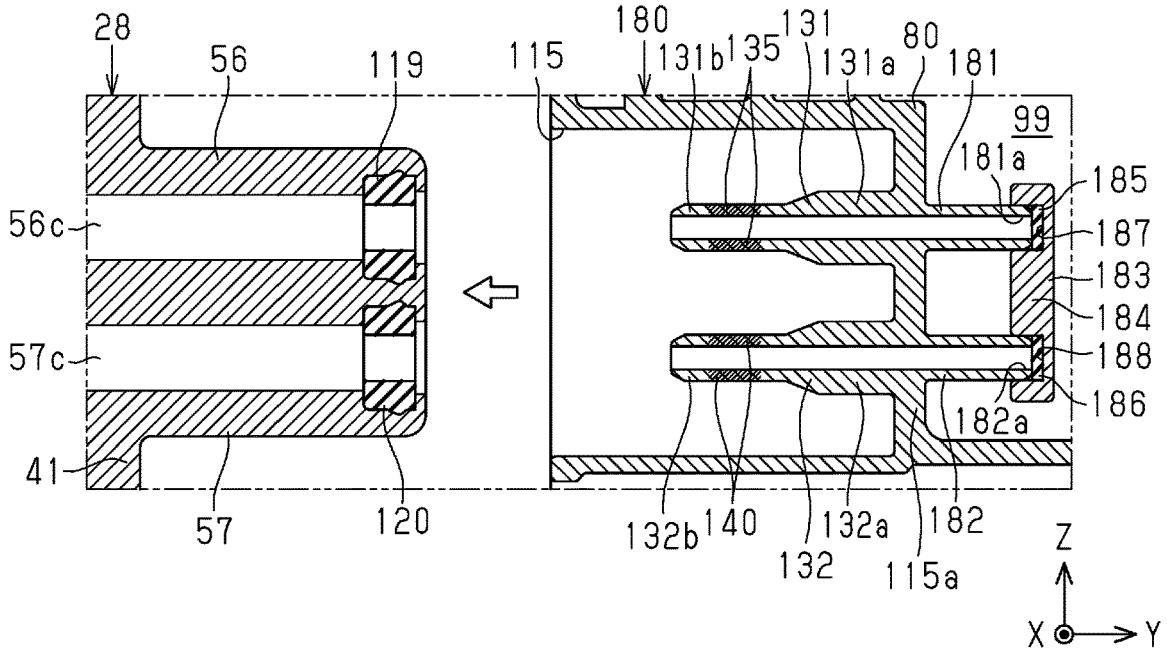
FIG. 14 is a cross-sectional view showing a state immediately before a cartridge not including an airbag is mounted on a cartridge mounting section in a fifth embodiment.
Figure 15:
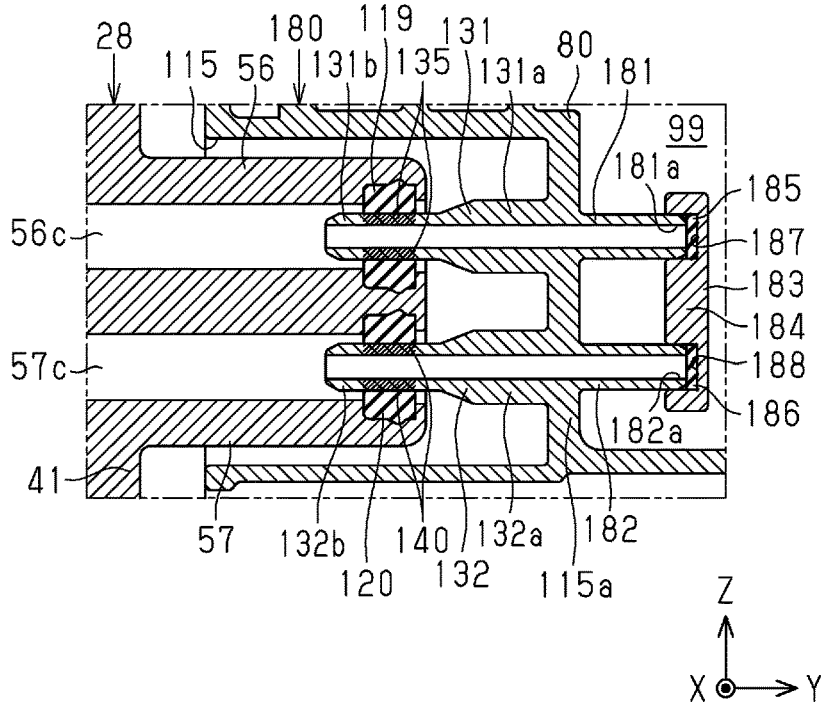
FIG. 15 is a cross-sectional view showing a state in which the cartridge of FIG. 14 is mounted on the cartridge mounting section.

As shown in FIGS. 14 and 15, a first communication portion 131 of the cartridge 180 includes a first inner tubular portion 181. The first inner tubular portion 181 is a tubular protrusion extending in the +Y direction from the bottom wall 115*a* in the pressurizing chamber 99. The second communication portion 132 includes a second inner tubular portion 182. The second inner tubular portion 182 is located in a region on the −Z direction side with respect to the first inner tubular portion 181. The second inner tubular portion 182 is a tubular protrusion extending in the +Y direction from the bottom wall 115*a* in the pressurizing chamber 99.

The cartridge 180 includes a cap 183 that is a second leakage limiting portion. The cap 183 airtightly closes a distal end port 181*a* of the first inner tubular portion 181 and a distal end port 182*a* of the second inner tubular portion 182. The distal end port 181*a* is an opening of the first communication portion 131 when the first communication portion 131 communicates with the space on the inner side of the case 80. The distal end port 182*a* is an opening of the second communication portion 132 when the second communication portion 132 communicates with the space on the inner side of the case 80. The cap 183 includes a cap body 184 and sheet-like seal members 185 and 186. The cap body 184 may be made by molding a synthetic plastic such as polypropylene or polystyrene. The cap body 184 has first and second insertion recesses 187 and 188. The distal end of the first inner tubular portion 181 and the distal end of the second inner tubular portion 182 are inserted into the first and second insertion recesses 187 and 188, respectively. The seal members 185 and 186 are members having elasticity, and are made of, for example, rubber. The seal members 185 and 186 are joined to the bottom wall of the first insertion recess 187 and the bottom wall of the second insertion recess 188, respectively. For example, the cap 183 is attached to the cartridge 180 by joining the cap body 184 to the distal end of the first inner tubular portion 181 and the distal end of the second inner tubular portion 182.

For the joining of the cap body 184 and the joining of the seal members 185 and 186, for example, a method suitable for the material of each seal member can be selected in addition to adhesion. The seal members 185 and 186 do not necessarily need to be joined to the cap body 184. The attachment of the cap body 184 to the cartridge 180 is not limited to joining, and for example, may be a mechanical coupling such as snap engagement. For the cap 183, a cap corresponding to the first inner tubular portion 181 and a cap corresponding to the second inner tubular portion 182, for example, a stopper having elasticity such as rubber may be separately provided. Furthermore, the cap 183 may be a film joined to the first inner tubular portion 181 and the second inner tubular portion 182 so as to close the distal end ports 181*a* and 182*a*. The film in this case may close both distal end ports 181*a* and 182*a*, or may close the distal end ports 181*a* and 182*a* separately. The cap 183 does not necessarily need to include a seal member, and the cap body 184 may be joined to the first inner tubular portion 181 and the second inner tubular portion 182.

In the different cartridge 13 including the first and second airbags 103 and 105, the first fluid circulating passage 104 of the first stirring portion 94 is connected to the first inner tubular portion 181 and the second fluid circulating passage 106 of the second stirring portion 95 is connected to the second inner tubular portion 182. Thus, the first communication portion 131 is used as the first stirring fluid circulating portion 117, and the second communication portion 132 is used as the second stirring fluid circulating portion 118.

The operation and the advantages of the fifth embodiment will now be described.

(7) The cartridge 180 includes a cap 183. In the mounted state, the cap 183 limits leakage of pressurized air supplied by the first air supplying portion 56 to the pressurizing chamber 99 and leakage of pressurized air supplied by the second air supplying portion 57 to the pressurizing chamber 99.

Therefore, when pressurized air is supplied from the pressurizing mechanism 29 to the first air supplying portion 56 and the second air supplying portion 57, each of the second pressure and the third pressure easily satisfies the appropriate condition. Thus, errors caused by the second pressure or the third pressure are reduced. As a result, errors are unlikely to occur even if the cartridge 180 not including an airbag is mounted on the liquid ejection device 12 to which a different cartridge including an airbag is mountable.

(8) If the cap 183 is not attached, the case 80 can be used as a part of a different cartridge including an airbag. If the cap 183 is attached, the case 80 can be used as a part of a cartridge not including an airbag. That is, since the second leakage limiting portion is realized by attaching the cap 183, the flexibility in design of the case 80 with respect to the presence or absence of the airbag is improved.

Sixth Embodiment

A cartridge 195 and a liquid ejection system according to a sixth embodiment will be described with reference to FIGS. 16 and 17. The cartridge 195 not including an airbag and the liquid ejection system according to the sixth embodiment are different from the first embodiment in that the leakage of the pressurized air is limited by closing the air supplying passage 56*c*of the first air supplying portion 56 and the air supplying passage 57*c* of the second air supplying portion 57. Therefore, in the sixth embodiment, parts different from the first embodiment will be described, and the same parts will be denoted by the same reference numerals and detailed description thereof will be omitted.

Figure 16:
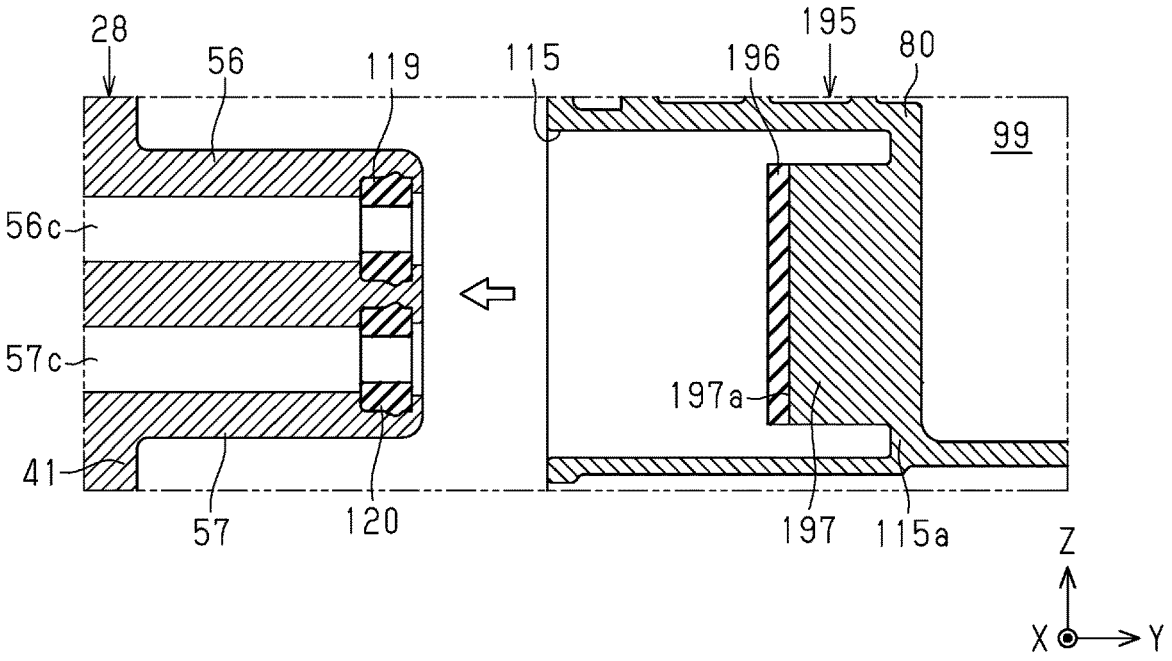
FIG. 16 is a cross-sectional view showing a state immediately before a cartridge not including an airbag is mounted on a cartridge mounting section according to a sixth embodiment.
Figure 17:
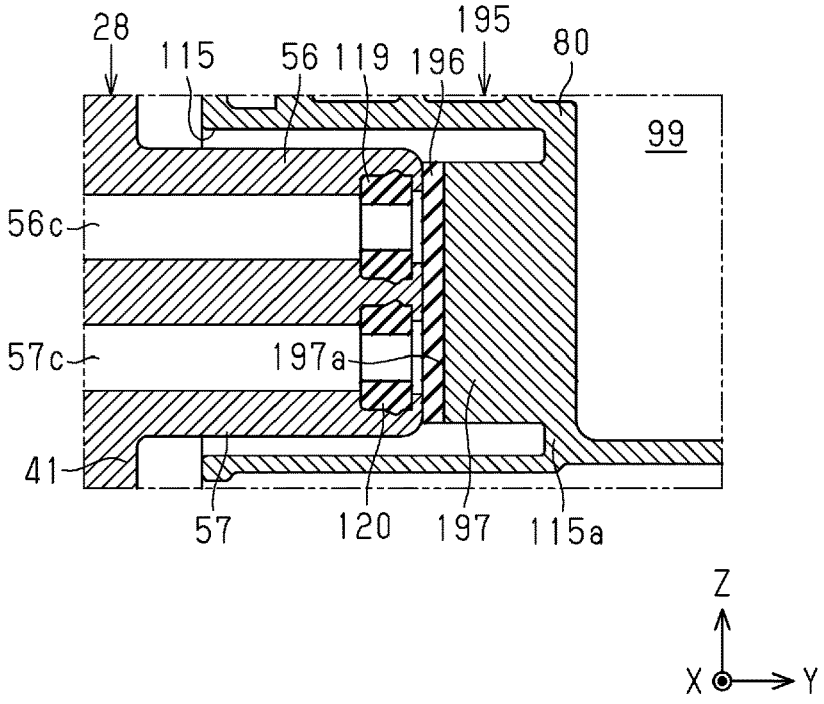
FIG. 17 is a cross-sectional view showing a state in which the cartridge of FIG. 16 is mounted on the cartridge mounting section.

As shown in FIGS. 16 and 17, the cartridge 195 has a sheet-like seal member 196. The seal member 196 closes the ends in the +Y direction of the air supplying passage 56*c* of the first air supplying portion 56 and the air supplying passage 57*c* of the second air supplying portion 57 in the mounted state. The seal member 196 is a member having elasticity, and is made of, for example, rubber. The seal member 196 is joined to the case 80 by a joining method such as adhesion. The case 80 has a projection 197. The projection 197 extends from the bottom wall 115*a* of the recess 115 in the −Y direction which is the mounting direction. The distal end face of the projection 197 is a supporting surface 197*a* to which the seal member 196 is joined. The supporting surface 197*a* is orthogonal to the Y axis. The seal member 196 is a leakage limiting portion. The seal member 196 closes the air supplying passage 56*c* and the air supplying passage 57*c* to limit leakage of the pressurized air supplied from the first air supplying portion 56 and the second air supplying portion 57 into the atmosphere and leakage to the pressurizing chamber 99.

The operation and the advantages of the sixth embodiment will now be described.

(9) The cartridge 195 has a seal member 196. The seal member 196 closes the air supplying passage 56*c* and the air supplying passage 57*c* by being sandwiched between the first and second air supplying portions 56 and 57 and the case 80 in the mounted state. Therefore, when pressurized air is supplied from the pressurizing mechanism 29 to the first air supplying portion 56 and the second air supplying portion 57, each of the second pressure and the third pressure easily satisfies the appropriate condition. As a result, errors are unlikely to occur even if the cartridge 195 not including an airbag is mounted on the liquid ejection device 12 to which a different cartridge including an airbag is mountable.

Seventh Embodiment

A cartridge 200 and a liquid ejection system according to a seventh embodiment will be described with reference to FIGS. 18 and 19. The cartridge 200 not including an airbag and the liquid ejection system according to the seventh embodiment are different from the sixth embodiment in the configuration of the leakage limiting portion. Therefore, in the seventh embodiment, parts different from the sixth embodiment will be described, and the same parts will be denoted by the same reference numerals and detailed description thereof will be omitted.

Figure 18:
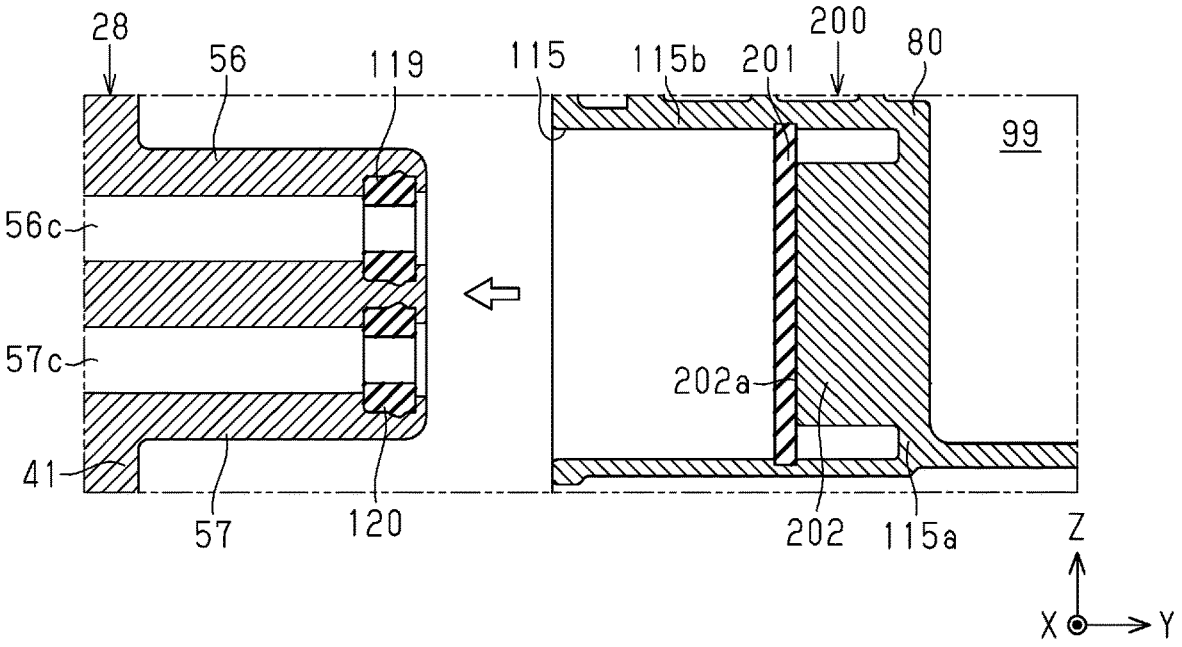
FIG. 18 is a cross-sectional view showing a state immediately before a cartridge not including an airbag is mounted on the cartridge mounting section according to a seventh embodiment.
Figure 19:
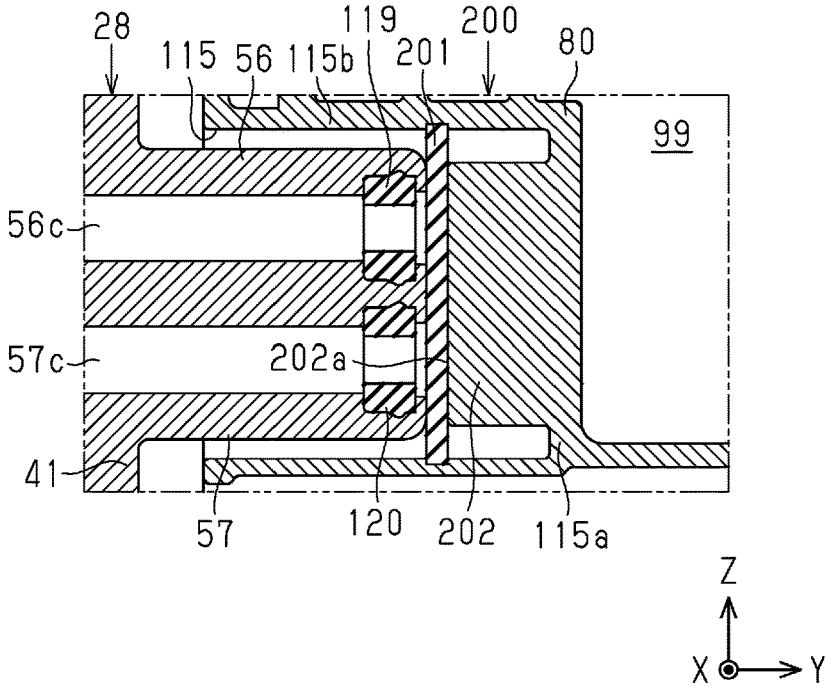
FIG. 19 is a cross-sectional view showing a state in which the cartridge of FIG. 18 is mounted on the cartridge mounting section.

As shown in FIGS. 18 and 19, the cartridge 200 has a sheet-like seal member 201. The seal member 201 closes the air supplying passage 56*c* of the first air supplying portion 56 and the air supplying passage 57*c* of the second air supplying portion 57 in the mounted state. The seal member 201 is a member having elasticity, and is made of, for example, rubber. The peripheral edge of the seal member 201 is joined to the side wall 115*b* of the recess 115 by a joining method such as adhesion. Accordingly, the seal member 201 is attached to the case 80. The case 80 has a projection 202. The projection 202 extends from the bottom wall 115*a* of the recess 115 in the −Y direction which is the mounting direction. The projection 202 has a distal end face 202*a* with which the seal member 201 comes into contact. The distal end face 202*a* is orthogonal to the Y axis. The seal member 201 is a leakage limiting portion. The seal member 201 limits the leakage of the pressurized air supplied by the first air supplying portion 56 and the second air supplying portion 57 into the atmosphere and the leakage into the pressurizing chamber 99 by closing the air supplying passage 56*c* and the air supplying passage 57*c* in the mounted state of the cartridge 200.

The operation and the advantages of the seventh embodiment will now be described.

(10) The cartridge 200 has a seal member 201. The seal member 201 closes the air supplying passage 56*c* and the air supplying passage 57*c* by being sandwiched between the first air supplying portion 56 and the second air supplying portion 57 and the case 80 in the mounted state. Thus, errors are unlikely to occur even if the cartridge 200 not including an airbag is mounted on the liquid ejection device 12 to which a different cartridge including an airbag is mountable.

(11) The seal member 201 is joined to the side wall 115*b* of the recess 115. In this case, for example, since there is no joining layer between the seal member 201 and the distal end face 202*a*, the unevenness caused by the joining layer does not appear on the surface of the seal member 201. This improves the sealability of the air supplying passage 56*c* and the air supplying passage 57*c* by the seal member 201.

The above-described embodiments may be modified as follows. The above-described embodiments and the following modifications can be combined as long as the combined modifications remain technically consistent with each other.

The cartridge 200 of the seventh embodiment may individually include a seal member that closes the air supplying passage 56*c* and a seal member that closes the air supplying passage 57*c*.

The case 80 arranged in the cartridge 200 of the seventh embodiment does not necessarily need to have a projection 202 extending in the −Y direction which is the mounting direction. That is, for example, the cartridge 200 may close the air supplying passages 56*c* and 57*c* with the seal member 201 sandwiched between the first air supplying portion 56 and the second air supplying portion 57 and the bottom wall 115*a* of the recess 115.

The cartridge 195 of the sixth embodiment may individually include a seal member that closes the air supplying passage 56*c* and a seal member that closes the air supplying passage 57*c*.

The case 80 arranged in the cartridge 195 of the sixth embodiment does not necessarily need to have the projection 197 extending in the −Y direction which is the mounting direction. That is, the cartridge 195 may include, for example, a seal member 196 joined to the bottom wall 115*a* of the recess 115, and the air supplying passage 56*c* and the air supplying passage 57*c* may be closed by the seal member 196.

The leakage limiting portion that limits air leakage from the air supplying passage merely needs to have a structure that closes the air supplying passage. Therefore, the leakage limiting portion may close the supplying passage with the case itself without using a seal member. For example, the leakage limiting portion may change the position of the bottom wall 115*a* of the recess 115 to close the air supplying passage with the bottom wall 115*a*, or may close the air supplying passage with the distal end face of the projection 197 described above.

Furthermore, for example, the leakage limiting portion may be a protrusion that is integrally connected to the case 80 and is inserted into the air supplying passage in the mounting process. An example of such a protrusion can be embodied by arranging the first partition wall 136 so as to fill the internal space of the first large diameter portion 131*a* and the first small diameter portion 131*b* with respect to the first communication portion 131 of the first embodiment, as shown in the first modification of FIG. 20. Furthermore, an example of the protrusion can be embodied by arranging the second partition wall 141 so as to fill the internal space of the second large diameter portion 132*a* and the second small diameter portion 132*b* with respect to the second communication portion 132 of the first embodiment. The case 80 does not necessarily need to include the first inner tubular portion 142 and the second inner tubular portion 143. The first inner tubular portion 142 is a part to which the first fluid circulating passage 104 of the first stirring portion 94 can be connected, and the second inner tubular portion 143 is a part to which the second fluid circulating passage 106 of the second stirring portion 95 can be connected.

Figure 21:
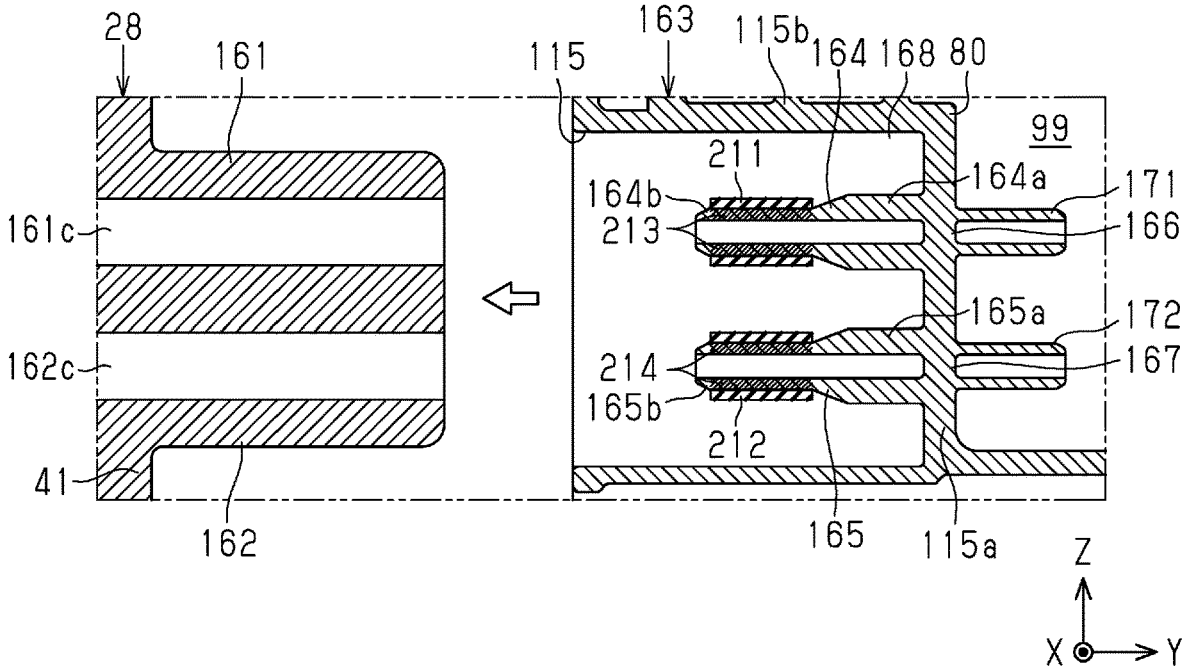
FIG. 21 is a cross-sectional view showing a state immediately before a cartridge not including an airbag is mounted on a cartridge mounting section according to a second modification.

As in the third and fourth embodiments, the first leakage limiting portion may be changed to a structure shown in FIG. 21 in a structure in which the first and second small diameter portions 164*b* and 165*b* of the first and second communication portions 164 and 165 are respectively inserted into the air supplying passages 161*c* and 162*c* of the first and second air supplying portions 161 and 162.

As shown in the second modification of FIG. 21, the first communication portion 164 includes a seal member 211 on the outer peripheral portion of the first small diameter portion 164*b*. The seal member 211 seals the gap with the first air supplying portion 161 in the mounted state. The first leakage limiting portion corresponding to the first air supplying portion 161 includes the seal member 211 and the first supporting portion 213. The first supporting portion 213 is a portion that supports the seal member 211 in the first communication portion 164.

Figure 20:
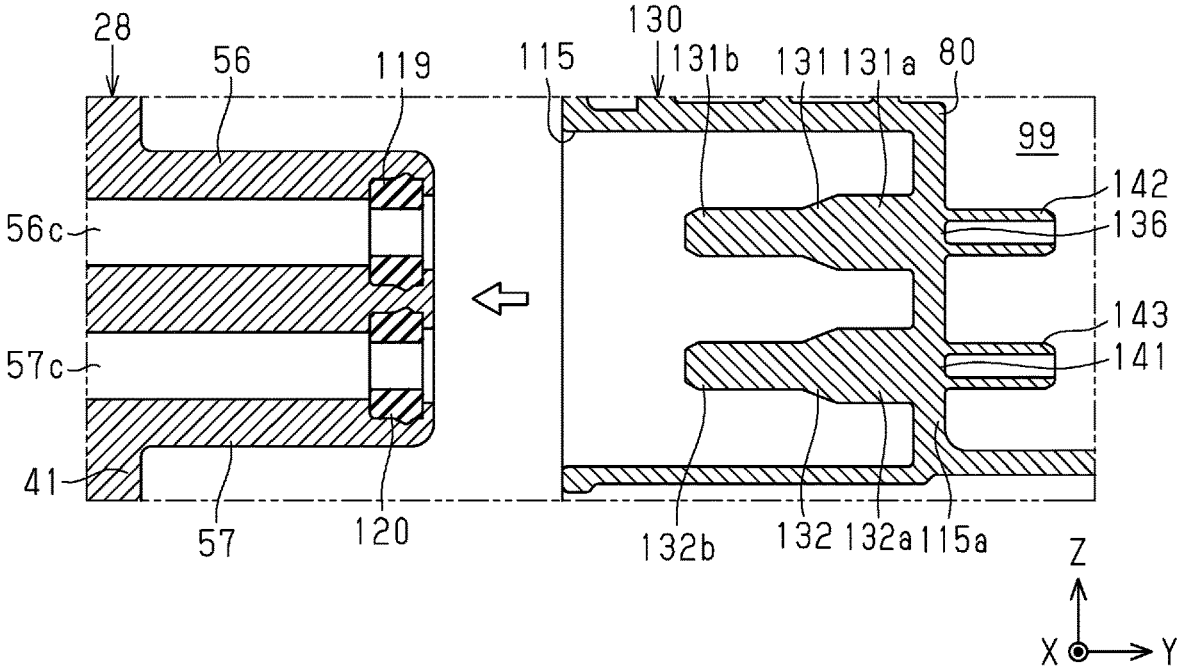
FIG. 20 is a cross-sectional view showing a state immediately before a cartridge not including an airbag is mounted on a cartridge mounting section according to a first modification.

The second communication portion 165 includes a seal member 212 on the outer peripheral portion of the second small diameter portion 165*b*. The seal member 212 seals the gap with the second air supplying portion 162 in the mounted state. The first leakage limiting portion corresponding to the second air supplying portion 162 includes the seal member 212 and the second supporting portion 214. The second supporting portion 214 is a portion that supports the seal member 212 in the second communication portion 165. In FIG. 20, a portion corresponding to the first supporting portion 213 and a portion corresponding to the second supporting portion 214 are indicated by cross hatching.

When the first and second air supplying portions 146 and 147 are inserted into the first and second communication portions 151 and 152, respectively, as in the second embodiment, a seal member may be arranged on the outer peripheral portion of the first and second small diameter portions 146*b*, 147*b* of the second air supplying portions 146 and 147 in place of the first and second seal members 153, 156.

The case 80 of the first to fourth embodiments does not necessarily need to include the first inner tubular portion and the second inner tubular portion projecting out in the +Y direction from the bottom wall 115*a* in the pressurizing chamber 99. A greater amount of ink can be stored in the ink container 100 by increasing the volume of the pressurizing chamber 99.

The first leakage limiting portion may limit leakage of pressurized air into the atmosphere by increasing the passage resistance in the gap between the air supplying portion and the communication portion. Therefore, the first leakage limiting portion may be a portion having a shape for reducing the gap between the air supplying portion and the communication portion without using a seal member.

The second leakage limiting portion may limit the leakage of pressurized air to the pressurizing chamber 99 by having a shape for increasing the passage resistance in the communication portion.

The first partition wall and the second partition wall which are the second leakage limiting portion may be formed integrally with the case, or may be separate bodies from the case.

The dimension (thickness) along the Y axis and the position along the Y axis of the first partition wall and the second partition wall may be arbitrarily changed. For example, in the first embodiment, the first partition wall 136 may be disposed on at least one of the first large diameter portion 131*a* and the first small diameter portion 131*b*, or may be disposed to fill the internal space of the first large diameter portion 131*a* and the first small diameter portion 131*b*. The second partition wall 141 may be disposed in at least one of the second large diameter portion 132*a* and the second small diameter portion 132*b*, or may be disposed to fill the internal space of the second large diameter portion 132*a* and the second small diameter portion 132*b*.

In the liquid ejection device 12, the ink pressurizing portion 51, the first air supplying portion 56, and the second air supplying portion 57 may be integrally formed, or may be separate bodies from each other. Furthermore, when the first air supplying portion 56 and the second air supplying portion 57 are separate bodies from the ink pressurizing portion 51, the first air supplying portion 56 and the second air supplying portion 57 may be integrally formed or may be separate bodies from each other.

The liquid ejection device 12 may include only one of the first air supplying portion 56 and the second air supplying portion 57. In such a case, the cartridge not including the airbag has a structure that limits leakage of pressurized air into the atmosphere and a structure that limits leakage of pressurized air into the case so as to correspond to one of the first air supplying portion 56 and the second air supplying portion 57.

The liquid ejection device 12 may include an air supplying portion in addition to the first air supplying portion 56 and the second air supplying portion 57. In such a case, the cartridge not including the airbag has a structure that limits leakage of pressurized air into the atmosphere and a structure that limits leakage of pressurized air into the case so as to correspond to each air supplying portion.

A cartridge not including an airbag may have a through passage in the case 80 through which the externally supplied ink passes, in addition to storing the ink container 100 in the case 80.

Figure 22:
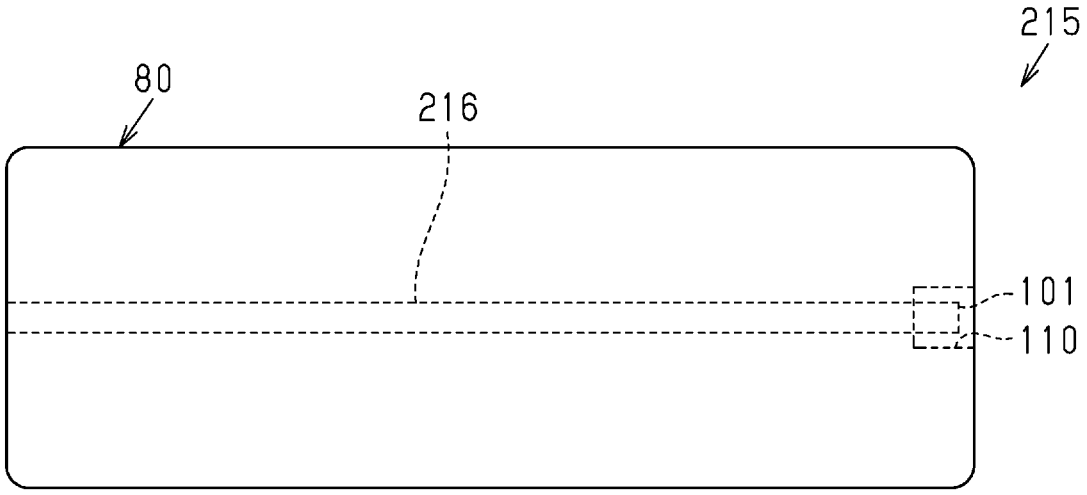
FIG. 22 is a cross-sectional view schematically showing a cartridge not including an airbag according to a third modification.

FIG. 22 is a third modification showing an example of a cartridge including the through passage described above. As shown in FIG. 22, a cartridge 215 includes a case 80, a through passage 216 disposed in the case 80, and an ink lead-out portion 101 disposed at the first end of the through passage 216. The second end of the through passage 216 may be connected to a supply source connecting portion included in the case 80, or may be connected to an external ink supply source through the case 80. The through passage 216 may be, for example, a tube having flexibility.

Each of the first leakage limiting portion, the second leakage limiting portion, and the leakage limiting portion merely needs to have a structure that can limit air leakage when pressurized air is supplied from the pressurizing mechanism 29 and maintain a predetermined air pressure. Therefore, a state sealed by the seal member and a state in which the air supplying passage is closed are not limited to a completely sealed state, and include a state in which a gap enough to maintain the predetermined air pressure when pressurized air is supplied from the pressurizing mechanism 29 is provided.

The control section 38, which is a detection section, may be circuitry including: 1) one or more processors that operate according to a computer program (software); 2) one or more dedicated hardware circuits such as application specific integrated circuits (ASIC) that execute at least part of various processes, or 3) a combination thereof. The processor includes a CPU and memories such as a RAM and a ROM. The memories store program codes or commands configured to cause the CPU to execute processes. The memories, or computer readable media, include any type of media that are accessible by general-purpose computers and dedicated computers.

The liquid ejection device 12 may be a liquid ejection device that ejects or jets liquid other than ink. The state of the liquid jetted from the liquid ejection device as a minute amount of liquid droplets includes granular, tear-like, and thread-like ones. The liquid here may be any material that can be ejected from the liquid ejection device. For example, the liquid may be in a state in which the substance is in a liquid phase, and includes fluid body such as a liquid body with high or low viscosity, sol, gel water, other inorganic solvent, organic solvent, solution, liquid plastic, liquid metal, and metal melt. The liquid includes not only a liquid as one state of a substance but also a liquid in which particles of the functional material including a solid such as pigments and metal particles are dissolved, dispersed or mixed in a solvent. Typical examples of the liquid include ink and liquid crystal as described in the above embodiment. The ink includes general water-based inks and oil-based inks, and various liquid compositions such as gel inks and hot melt inks. As a specific example of the liquid ejection device, for example, a device that ejects liquid including a material such as an electrode material or a color material used for manufacturing a liquid crystal display, an electroluminescence display, a surface light emitting display, a color filter or the like in the form of dispersed or dissolved state. The liquid ejection device may be a device that ejects a bio-organic matter used for biochip manufacturing, a device that ejects a liquid that is used as a precision pipette, or a sample, a printing device, a micro dispenser, or the like. The liquid ejection device may be a device that ejects lubricating oil with pinpoint accuracy to a precision machine such as watches and cameras, or a device that ejects onto a substrate a transparent plastic such as UV curable plastic to form micro hemispherical lenses used for optical communication elements, optical lenses, and the like. The liquid ejection device may be a device that ejects an etchant such as acid or alkali in order to etch a substrate or the like.

Examples that are obtainable from the above embodiment will now be described.

EXAMPLE 1

A cartridge mountable on a liquid ejection device, wherein the liquid ejection device includes a mounting section to which the cartridge and a different cartridge including an airbag are replaceably mounted, the cartridge and the different cartridge capable of supplying liquid to a liquid ejection head that ejects liquid;

an air supplying portion including an air supplying passage, the air supplying portion being configured to supply air to the airbag of the different cartridge mounted on the mounting section; and a detection section configured to detect an error when a predetermined air pressure is not reached even if air is supplied from the air supplying portion, the cartridge includes a case that stores the liquid or allows the externally supplied liquid to pass through, the case including a communication portion that communicates with the air supplying passage in a mounted state in which the cartridge is mounted on the liquid ejection device, and a first leakage limiting portion that limits leakage of air supplied from the air supplying portion into an atmosphere by cooperating with the air supplying portion in the mounted state, and the communication portion includes a second leakage limiting portion that limits leakage of the air supplied from the air supplying portion into the case through the communication portion.

The leakage of air supplied from the air supplying portion into the atmosphere and the leakage into the case are limited by mounting the cartridge on the liquid ejection device. Therefore, even if the cartridge does not include an airbag, errors are unlikely to occur.

EXAMPLE 2

The cartridge according to Example 1 may be configured such that the communication portion includes a tubular portion extending in a mounting direction of the cartridge from the case, the communication portion communicates with the air supplying passage by inserting the tubular portion into the air supplying passage, the air supplying portion includes a seal member that seals a gap between the peripheral wall of the air supplying portion and the peripheral wall of the tubular portion in the mounted state, and the first leakage limiting portion is a portion of the peripheral wall of the tubular portion that comes into contact with the seal member.

When the communication portion and the air supplying portion are connected by inserting the tubular portion into the air supplying passage, leakage of air supplied from the air supplying portion to the atmosphere is limited by sealing the gap between the peripheral wall of the air supplying portion and the peripheral wall of the tubular portion with a seal member provided in the air supplying portion.

EXAMPLE 3

The cartridge according to Example 1 may be configured such that the communication portion includes a tubular portion extending in the mounting direction of the cartridge from the case, the communication portion communicates with the air supplying passage by inserting the air supplying portion to a distal end port of the tubular portion, the cartridge includes a seal member supported by the tubular portion, the seal member sealing a gap between the peripheral wall of the tubular portion and the peripheral wall of the air supplying portion in the mounted state, and the first leakage limiting portion includes the seal member and a portion of the peripheral wall of the tubular portion that supports the seal member.

When the communication portion and the air supplying portion are connected by inserting the air supplying portion to the distal end port of the communication portion, leakage of air supplied from the air supplying portion to the atmosphere is limited by sealing the gap between the peripheral wall of the air supplying portion and the peripheral wall of the tubular portion with a seal member provided in the communication portion.

EXAMPLE 4

The cartridge according to Example 1 may be configured such that the communication portion includes a tubular portion extending in a mounting direction of the cartridge from the case, the communication portion communicates with the air supplying passage by inserting the tubular portion into the air supplying passage, the case includes a recess, the recess may includes a bottom wall that supports a proximal end of the tubular portion, and a side wall that surrounds the peripheral wall of the air supplying portion in the mounted state, the cartridge includes a seal member supported by the side wall, the seal member sealing a gap between the side wall of the recess and the peripheral wall of the air supplying portion in the mounted state, and the first leakage limiting portion includes the seal member, and a portion of the side wall of the recess that supports the seal member.

When the cartridge includes a recess surrounding the peripheral wall of the air supplying portion in the mounted state, leakage of air supplied from the air supplying portion into the atmosphere is limited by sealing the gap between the side wall of the recess and the peripheral wall of the air supplying portion with the seal member supported by the side wall of the recess.

EXAMPLE 5

The cartridge according to Example 1 may be configured such that the communication portion includes a tubular portion extending in the mounting direction of the cartridge from the case, the communication portion communicates with the air supplying passage by inserting the tubular portion into the air supplying passage, the case may include a recess, the recess includes a bottom wall that supports a proximal end of the tubular portion, and a side wall that surrounds the peripheral wall of the air supplying portion in the mounted state, the air supplying portion includes a seal member that seals a gap between the side wall of the recess and the peripheral wall of the air supplying portion in the mounted state, and the first leakage limiting portion is a portion of the side wall of the recess that comes into contact with the seal member.

When the cartridge includes a recess surrounding the air supplying portion in the mounted state, leakage of air supplied from the air supplying portion into the atmosphere is limited by sealing the gap between the side wall of the recess and the peripheral wall of the air supplying portion with the seal member supported by the air supplying portion.

EXAMPLE 6

The cartridge according to any one of Examples 1 to 5 may be configured such that the second leakage limiting portion is a partition wall arranged in the communication portion, and the partition wall separates a space on the inner side of the case and a space on the outer side of the case from each other.

The air supplied from the air supplying portion is limited from flowing into the case since the communication portion includes the partition wall.

EXAMPLE 7

The cartridge according to any one of Examples 1 to 5 may be configured such that the second leakage limiting portion may be a cap that closes an opening of the communication portion to the space on the inner side of the case.

In this case, for example, the second leakage limiting portion can be provided also for the case of the existing cartridge.

EXAMPLE 8

A cartridge mountable on a liquid ejection device, wherein the liquid ejection device includes a mounting section to which the cartridge and a different cartridge including an airbag are replaceably mounted, the cartridge and the different cartridge capable of supplying liquid to a liquid ejection head that ejects liquid, an air supplying portion including an air supplying passage, the air supplying portion being configured to supply air to the airbag of the different cartridge mounted on the mounting section, and a detection section configured to detect an error when a predetermined air pressure is not reached even if air is supplied from the air supplying portion, the cartridge includes a case that stores the liquid or allows the externally supplied liquid to pass through, and the case includes a leakage limiting portion that limits leakage of air from the air supplying passage by closing the air supplying passage in the mounted state in which the cartridge is mounted on the liquid ejection device.

The air supplying passage of the air supplying portion is closed by mounting the cartridge on the liquid ejection device. Therefore, the leakage of the air supplied by the air supplying portion to the atmosphere and the leakage to the inside of the case are limited. This makes it difficult for errors to occur even if the cartridge does not include an airbag.

EXAMPLE 9

The cartridge according to Example 8 may be configured such that the leakage limiting portion includes a seal member supported by the case, and the seal member may close the air supplying passage by being sandwiched between a distal end of the air supplying portion and the case in the mounted state.

In this case, the air supplying passage is closed by the seal member sandwiched between the distal end of the air supplying portion and the case in the mounted state.

EXAMPLE 10

The cartridge according to Example 9 may be configured such that the case includes a projection extending in the mounting direction of the cartridge, and the seal member is supported by a distal end of the projection and closes the air supplying passage by being sandwiched between the distal end of the air supplying portion and the distal end of the projection in the mounted state.

In this case, in the mounted state, the air supplying passage is closed by the seal member sandwiched between the distal end of the air supplying portion and the distal end of the projection of the case.

EXAMPLE 11

The cartridge according to Example 9 may be configured such that the case includes a projection extending in a mounting direction of the cartridge, and a recess, the recess includes a bottom wall that supports a proximal end of the projection, and a side wall extending in the mounting direction from a peripheral edge of the bottom wall, the side wall surrounding a peripheral wall of the air supplying portion in the mounted state, and the seal member is supported by the side wall and closes the air supplying passage by being sandwiched between the distal end of the air supplying portion and a distal end of the projection in the mounted state.

In this case, the air supplying passage is closed by the seal member supported by the side wall of the recess being sandwiched between the distal end of the air supplying portion and the distal end of the projection.

EXAMPLE 12

A liquid ejection system including the cartridge according to any one of Examples 1 to 11, a liquid ejection head that ejects liquid, a mounting section to which the cartridge and a different cartridge including an airbag are replaceably mounted, a liquid supplying portion configured to supply the liquid from the cartridge or a different cartridge mounted on the mounting section to the liquid ejection head, an air supplying portion configured to supply air to the airbag, and a detection section configured to detect an error when a predetermined air pressure is not reached even if air is supplied from the air supplying portion.

In this case, the advantages similar to the cartridge according to any one of Examples 1 to 11 are obtained.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

The invention claimed is:

1. A cartridge mountable on a liquid ejection device, wherein the liquid ejection device includes a mounting section to which the cartridge and a different cartridge including an airbag are replaceably mounted, the cartridge and the different cartridge being capable of supplying liquid to a liquid ejection head that ejects the liquid, an air supplying portion including an air supplying passage, the air supplying portion being configured to supply air to the airbag of the different cartridge mounted on the mounting section, and a detection section configured to detect an error when a predetermined air pressure is not reached even if air is supplied from the air supplying portion, the cartridge comprises:

a case that stores the liquid or allows the externally supplied liquid to pass through, the case including a communication portion that communicates with the air supplying passage in a mounted state in which the cartridge is mounted on the liquid ejection device; and a first leakage limiting portion that limits leakage of air supplied from the air supplying portion into an atmosphere by cooperating with the air supplying portion in the mounted state, and the communication portion includes a second leakage limiting portion that limits leakage of the air supplied from the air supplying portion into the case through the communication portion.

2. The cartridge according to claim 1, wherein the communication portion includes a tubular portion extending in a mounting direction of the cartridge from the case, the communication portion communicates with the air supplying passage by inserting the tubular portion into the air supplying passage, the air supplying portion includes a seal member that seals a gap between a peripheral wall of the air supplying portion and a peripheral wall of the tubular portion in the mounted state, and the first leakage limiting portion is a portion of the peripheral wall of the tubular portion that comes into contact with the seal member.

3. The cartridge according to claim 1, wherein the communication portion includes a tubular portion extending in a mounting direction of the cartridge from the case, the communication portion communicates with the air supplying passage by inserting the air supplying portion to a distal end port of the tubular portion, the cartridge comprises a seal member supported by the tubular portion, the seal member sealing a gap between a peripheral wall of the tubular portion and a peripheral wall of the air supplying portion in the mounted state, and the first leakage limiting portion includes the seal member and a portion of the peripheral wall of the tubular portion that supports the seal member.

4. The cartridge according to claim 1, wherein the communication portion includes a tubular portion extending in a mounting direction of the cartridge from the case, the communication portion communicates with the air supplying passage by inserting the tubular portion into the air supplying passage, the case includes a recess, the recess includes a bottom wall that supports a proximal end of the tubular portion, and a side wall that surrounds a peripheral wall of the air supplying portion in the mounted state, the cartridge comprises a seal member supported by the side wall, the seal member sealing a gap between the side wall of the recess and a peripheral wall of the air supplying portion in the mounted state, and the first leakage limiting portion includes the seal member, and a portion of the side wall of the recess that supports the seal member.

5. The cartridge according to claim 1, wherein the communication portion includes a tubular portion extending in a mounting direction of the cartridge from the case, the communication portion communicates with the air supplying passage by inserting the tubular portion into the air supplying passage, the case include a recess, the recess includes a bottom wall that supports a proximal end of the tubular portion, and a side wall that surrounds a peripheral wall of the air supplying portion in the mounted state, the air supplying portion includes a seal member that seals a gap between the side wall of the recess and a peripheral wall of the air supplying portion in the mounted state, and the first leakage limiting portion is a portion of the side wall of the recess that comes into contact with the seal member.

6. The cartridge according to claim 1, wherein the second leakage limiting portion is a partition wall arranged in the communication portion, and the partition wall separates a space on an inner side of the case and a space on an outer side of the case from each other.

7. The cartridge according to claim 1, wherein the second leakage limiting portion is a cap that closes an opening of the communication portion to the space on the inner side of the case.

8. A liquid ejection system comprising:

the cartridge according to claim 1;

a liquid ejection head that ejects liquid;

a mounting section to which the cartridge and a different cartridge including an airbag are replaceably mounted;

a liquid supplying portion configured to supply the liquid from the cartridge or the different cartridge mounted on the mounting section to the liquid ejection head;

an air supplying portion configured to supply air to the airbag; and a detection section configured to detect an error when a predetermined air pressure is not reached even if air is supplied from the air supplying portion.

* * * * *